US005988825A

United States Patent [19]

Masters et al.

[11] Patent Number: 5,988,825

[45] Date of Patent: Nov. 23, 1999

[54] HOUSING FRAME FOR ILLUMINATED SIGNS HAVING MULTIPLE CONFIGURATIONS

[75] Inventors: Andrew Edward Masters, Lawrenceville; James Michael Lay, Grayson, both of Ga.

[73] Assignee: NSI Enterprises, Inc., Atlanta, Ga.

[21] Appl. No.: 08/850,494

[22] Filed: May 2, 1997

[51] Int. Cl.[6] ..... G09F 13/04

[52] U.S. Cl. ..... 362/20; 362/249; 362/800; 362/812; 40/570

[58] Field of Search ..... 362/800, 812, 362/249, 20, 235; 40/570, 580

[56] References Cited

U.S. PATENT DOCUMENTS

| | | | |
|---|---|---|---|
| 5,303,124 | 4/1994 | Wrobel | 362/20 |
| 5,410,453 | 4/1995 | Ruskouski | 362/812 |
| 5,768,814 | 6/1998 | Kozek et al. | 362/20 |

*Primary Examiner*—Thomas M. Sember
*Attorney, Agent, or Firm*—Kenneth E. Darnell

[57] ABSTRACT

A housing frame preferably formable as a single integral unit and being capable of use as a primary structural portion of a housing suitable for multiple exit sign configurations, the several exit sign configurations of the invention being either intended for emergency or non-emergency operation and further being intended for use with different light sources and power sources. The housing frame of the invention includes structural features which allow mounting of any one of a variety of light sources and mounting of those components necessary for operation of the light sources within a single housing, which housing is of a size reduced in volume relative to most presently available signs. Structural features of the frame also include in at least certain embodiments a printed circuit board comprising a platform and having essentially all circuit components including light emitting diode light sources and a battery for operation of the light sources in an emergency mode mounted on said printed circuit board. The printed circuit board or platform is mounted immediately above a floor of the housing frame by a support structure comprising an irregular vertical wall extending upwardly from the floor of the housing frame. The frame and associated plates forming the housing of the invention are preferably formed from polymeric material of a thickness less than that of prior "plastic" housings, the strength and rigidity necessary to proper operation of the housing being provided by a functionally interrelated combination of structural elements which allows a substantial reduction in material used for formation of the housing.

47 Claims, 19 Drawing Sheets

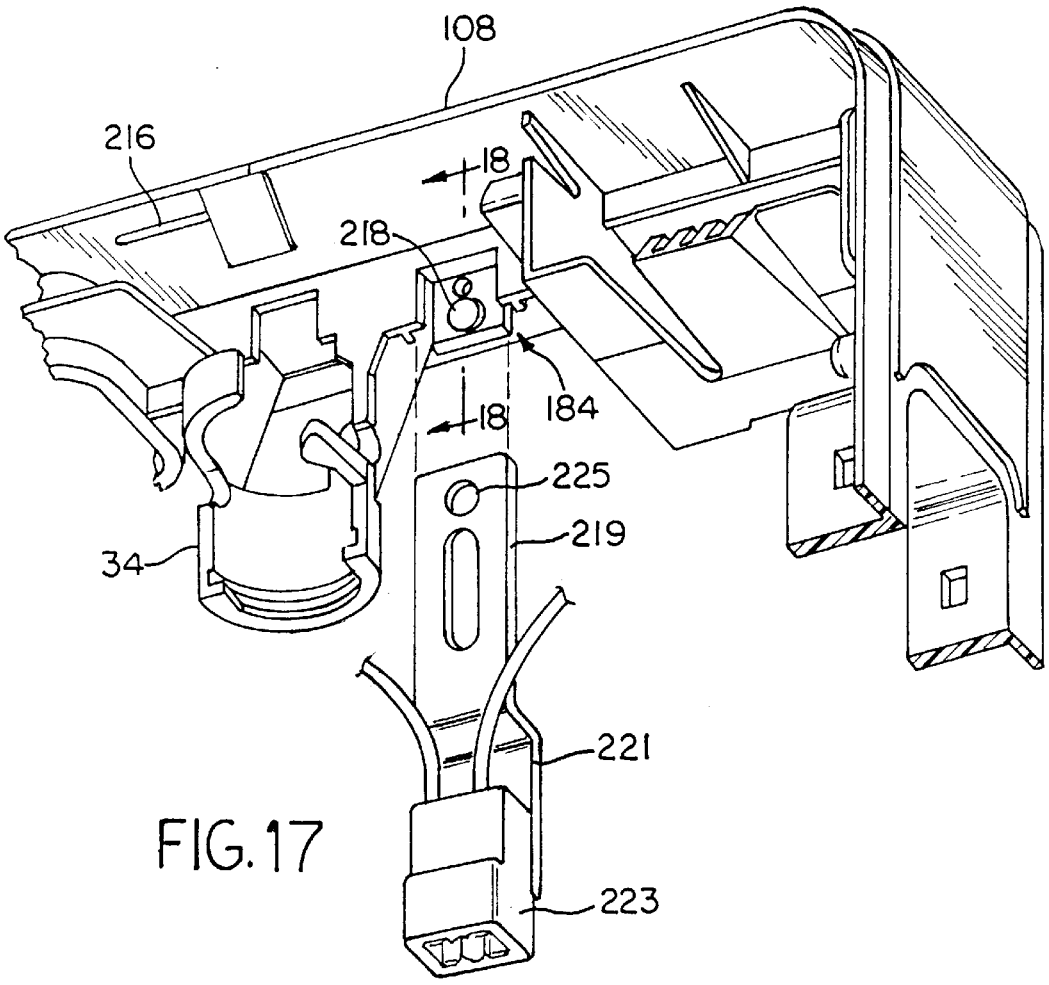
FIG. 17
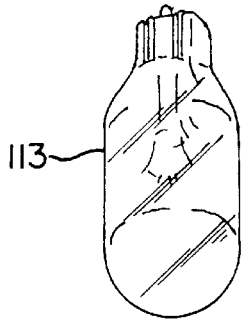
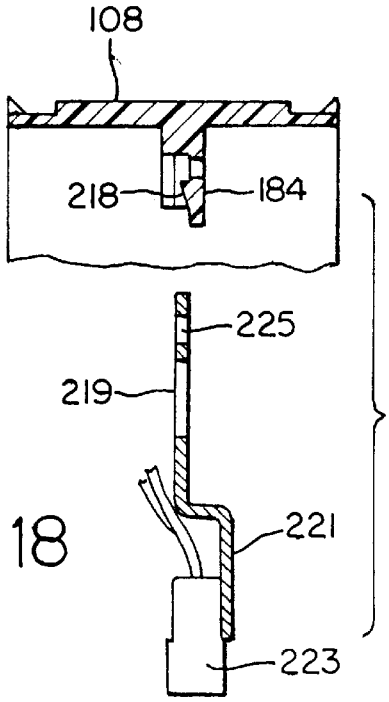
FIG. 18

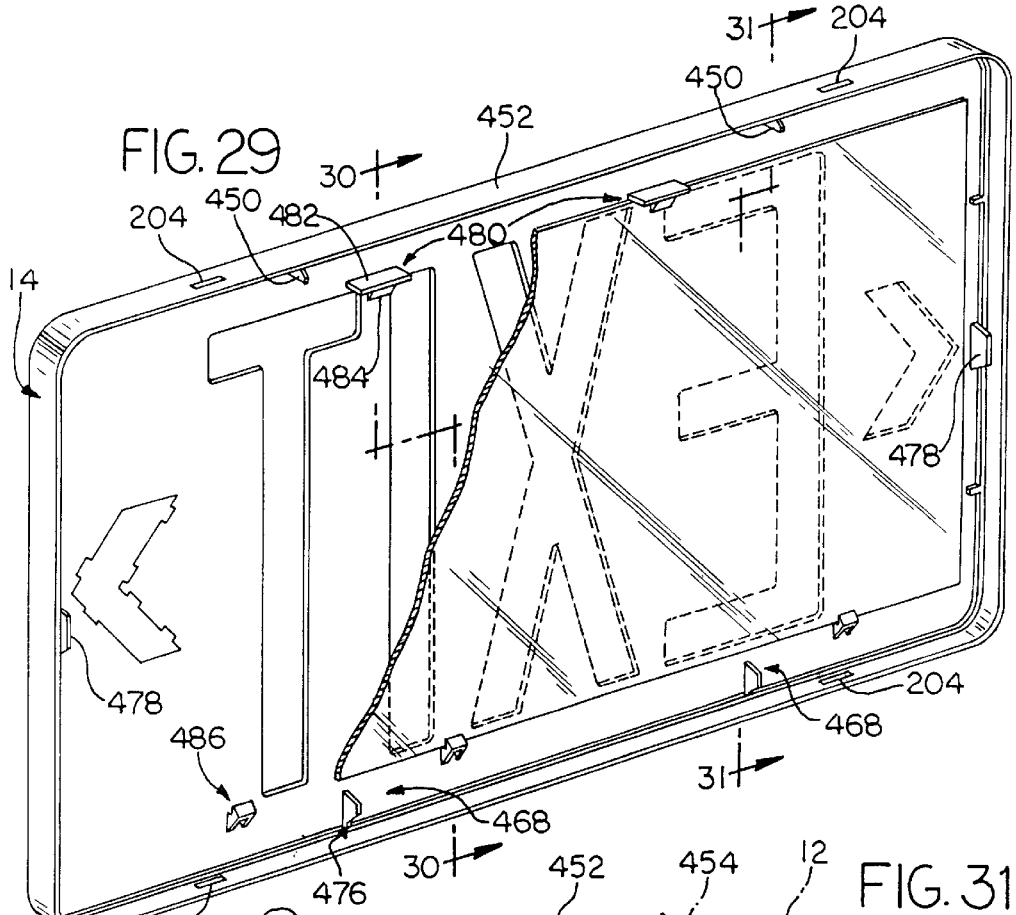
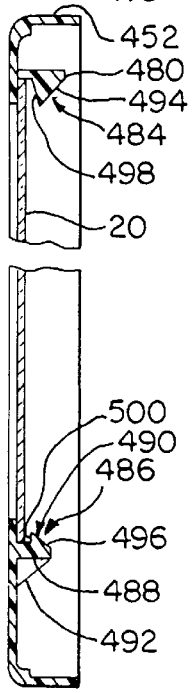
FIG. 30
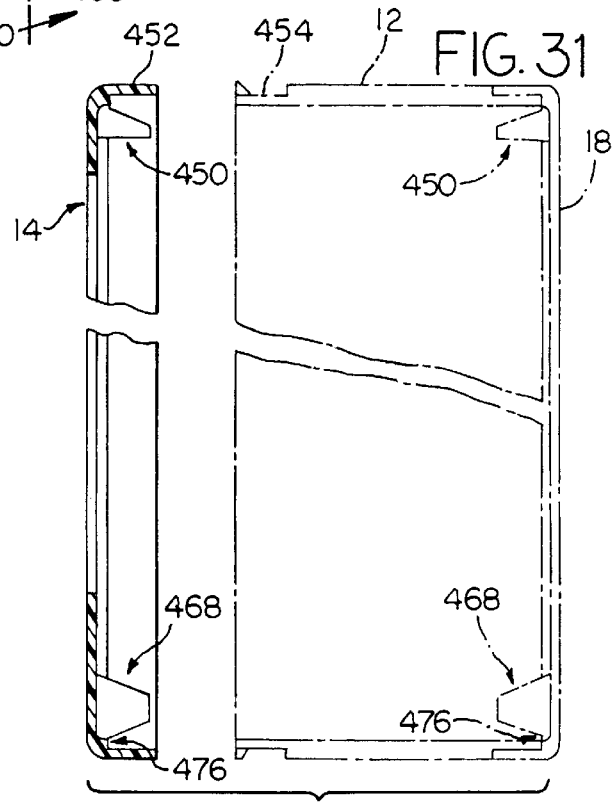

HOUSING FRAME FOR ILLUMINATED SIGNS HAVING MULTIPLE CONFIGURATIONS

BACKGROUND OF THE INVENTION

1. Field of the Invention

The invention relates generally to illuminated signs such as exit signs having either emergency or non-emergency capabilities and particularly to exit signs which can be configured to be illuminated by selected light sources and having a standard housing frame forming a basic housing unit of the differing configurations of the exit signs.

2. Description of the Prior Art

Possibly the most common form of illuminated sign is the exit sign which can take a variety of physical configurations and utilize one or more light sources of differing type. Exit signs having the capability of operation in emergency situations often use two different light sources, one light source for non-emergency operation on AC mains power and a second light source for operation on emergency power, usually DC power provided by a battery. In usual applications, exit signs are placed above doorways or in egress paths to indicate the most efficient manner of exiting an environmental space in the event of emergency conditions. Certain types of exit signage operate only in a non-emergency mode when mains power is available, such signage being referred to in the industry as "standard" signs. The term "emergency" exit signage generally refers to those exit signs which operate in both non-emergency and emergency modes with an emergency mode being defined as a condition wherein mains power becomes unavailable to operate the light source normally used in the non-emergency mode. Discontinuation of a normal power supply in "emergency" exit signage causes an alternate source of power, usually DC power from a battery contained within the exit sign, to operate either the light source also used in the non-emergency mode or a second light source which usually functions only under emergency conditions. While incandescent light sources have long been used for operation in both normal and emergency modes, other sources such as arrays of light emitting diodes have received substantial acceptance due to low energy operation and long life. The use of light emitting diodes in the normal, non-emergency mode provides great advantages when coupled with the use of incandescent lamps as the emergency light source. Prior exit signs have also employed light emitting diodes as the sole light source in both normal, non-emergency operation and in emergency operation, the light emitting diodes being typically powered by AC mains power in the non-emergency mode and by direct current such as a battery contained within the exit sign or by direct current supplied from externally of the exit sign. The variety of light sources now available results in the necessity of providing a number of particular exit sign constructions which are designed to facilitate use of a particular light source or a particular combination of light sources. A manufacturer of exit signs must therefore design, fabricate and maintain in inventory a variety of different exit sign housings most of which are limited to use with only a single light source or a particular combination of light sources. Exit signs not capable of emergency operation typically are comprised of housings which are not suitable for the fabrication of exit signage which embody emergency capability. Since cost is ever a factor in the manufacture of exit signage, it is further to be noted that the molding of exit sign housings from polymeric materials has become wide-spread. The cost of tooling for production of molded sign housings has further resulted in a need to produce a housing which can be utilized as the basic support and containment unit for exit signs of differing type and function.

A need therefore exits in the art to provide illuminated signs and particularly exit signs which are inexpensive to manufacture and operate regardless of operation as "standard" or "emergency" signage. The art further finds a need for sign housings capable of use either without modification or with only slight modifications such as in the molding process for fabrication of different types of signage including different versions of "standard" signage and "emergency" signage. Such modifications can be primarily accomplished in molding of a basic frame used as the primary structural unit in the assembly of multiple purpose sign housings. A basic housing frame configured according to the invention can be molded from polymeric materials and can contain and support light sources such as an array of light emitting diodes and the like including an emergency mode power supply such as a battery and circuitry necessary for operation of the sign. In a particular embodiment of the invention, a substrate such as a printed circuit board can be used as a platform to support an array of light emitting diodes and those circuit components including a battery necessary for operation of the light emitting diode array in both "standard" and "emergency" embodiments, the same array of light emitting diodes being preferably driven in both normal and emergency modes in the emergency embodiments. The printed circuit board platform is mounted by a support structure formed on a floor of the sign, the support structure acting to mount the platform with exceptional stability to prevent warping or other distortion of the platform which could degrade illumination of the indicia formed in one or more face panels of the sign. Disposition of the light emitting diode array near the floor of the sign allows the interior volume of the sign to be substantially vacant, thereby increasing illumination of the indicia such as by increased reflection of light from the interior "ceiling" of the sign as well as increased total internal reflection.

Accordingly, the various aspects of the invention act to reduce the costs of and improve the performance of exit signage and particularly exit signage intended as signage exhibiting low initial equipment costs as well as low operational costs.

SUMMARY OF THE INVENTION

The disclosures of certain issued patents and pending United States patent applications are of interest relative to at least certain elements of the present invention in the several embodiments thereof. In particular, U.S. Pat. No. 5,526,251, issued Jun. 11, 1996, entitled "Emergency Lighting Connections" and assigned to the assignee of the present patent application, is relevant in a number of details including the use of a canopy to mount signs configured according to the invention and also including structure incorporated into the present signs for connection of the signs to a canopy. U.S. patent application Ser. No. 08/327,487, filed Oct. 21, 1994, now U.S. Pat. No. 5,611,163, entitled "Directional Indicator Covers for Emergency Lighting System" and assigned to the assignee of the present patent application is relevant at least to directional indicators useful with an exit sign and which find utility with the present signs. The disclosure of U.S. patent application Ser. No. 08/561,956, filed Nov. 22, 1995, now U.S. Pat. No. 5,979,673, entitled "Emergency Lighting Unit/Exit Sign Combination" and assigned to the assignee of the present patent application is relevant to a number of features useful in the present signs. United States patent application Ser. No. 08/675,109, now U.S. Pat. No. 5,739, 639 filed Jul. 3, 1996, entitled "Method and Apparatus for Operating LED Array and Charging Battery for Emergency LED Operation Including DC Boost Circuit Allowing Series Connection of LED Array and Battery" and assigned to the assignee of the present patent application discloses circuitry useful in the operation of at least one embodiment of the present invention. United States patent application Ser. No. 08/165,199, filed Dec. 13, 1993, entitled "Emergency Lighting System Incorporating Selective Control of Fixtures" and assigned to the assignee of the present patent application is relevant at least to the provision of power to one or more exit signs in a building from a source of power external of the signs. U.S. patent application Ser. No. 08/471,820, filed Jun. 7, 1995, now U.S. Pat. No. 5,640,792, entitled "Lighting Fixtures" and assigned to the assignee of the present patent application is relevant at least to the use of light emitting diodes of a given color to excite a transformation material to cause radiation of light from the material at a wave-length in a different band than the wavelength of the light which irradiates the transformation material. U.S. patent application Ser. No. 08/850,493, filed of even date and entitled "Light Distribution Diffuser for Exit Signs and the Like Illuminated by LED Arrays" and assigned to the assignee of the present patent application is relevant at least to the disclosure of diffuser structure mountable in surmounting relation to an array of light emitting diodes or the like for facilitating even light distribution within an illuminated sign such as an exit sign and for protection of an array of light emitting diodes or the like and associated circuitry. The disclosure of the foregoing patent and patent applications are incorporated hereinto by reference. Notice is also provided that other patented and unpatented devices useful with the present signs such as mounting canopies, lamping, directional indicators, etc., can be utilized for sign mounting, illumination, egress indication and the like as will be readily understood by those of ordinary skill in the art.

The invention provides emergency lighting fixtures intended as standard or emergency fixtures and which utilize a variety of light sources for internal illumination and a variety of power sources for driving the light sources employed in a particular embodiment of the invention. The lighting fixtures of the invention share a common housing and particularly a common housing frame which is preferably molded either as a single, unitary element having at least certain structural elements which are useful in some or all of the fixtures whether or not used in a particular version of the present fixtures. The housing frame of the invention forms a basic element from which certain structure not needed in a given version can be eliminated in the molding process through blockage of certain material flow passages within the mold. The housings of the invention including the basic housing frames are preferably formed of a polymeric material such as polycarbonate/ABS, molding of such a material allowing production of housing frames with structural elements necessary to produce the functions of the present fixtures being integrally formed with the housing frames, these molded structural elements and other structure contained within the housing being located in a manner whereby the structure internal of the housing produces synergistic effects as to strength and rigidity of the total structure in addition to the primary functions of the structure. In essence, the present lighting fixtures are totally integrated as to structure and function as well as being substantially integral in construction. Formation of the present fixtures essentially from moldable material further allows integral formation of fastening structural elements which eliminate the need for separate fasteners such as screws or the like in the assembly and mounting of the fixtures. In particular, snap-fitting structural elements formed integrally with the housing frames of the invention provide not only easy snap-fitting of facing plates to the housing frames to form the primary structural housings of the fixtures but also rapid and simple mounting of lamping, circuit-bearing platforms, wiring and the like. Assembly of the present fixtures is facilitated at least in part due to a reduced number of parts occasioned by the integral nature of the housing frames of the invention, cost also being reduced for similar reasons as well as for other reasons which will become more readily apparent as the structure of the present fixture is described in detail.

In certain embodiments of the invention wherein certain of the present fixtures operate only from AC mains power, it is not necessary to consider the weight of a battery, the usual emergency power supply in an "emergency" lighting fixture, in design of the fixture and in mounting of the fixture to a wall or ceiling of a building. However, in those embodiments of the invention wherein battery power supplants normal AC mains power when AC power is interrupted, the weight of the battery is normally a factor in fixture design and mounting. Battery weight usually forces the fixture housing to be of a heavier construction than would otherwise be necessary. Further, battery location can become critical with the additional problem that optimum battery location from a structural point of view often "shadows" the indicia on the face plate of an exit sign or the like, thereby causing illumination through the indicia to be less bright and therefore less easily perceived. The present invention is capable of utilizing a battery which can essentially be a single cell and which is characterized by a minimum weight, thereby allowing the battery and a light source driven by the battery to be mounted to a dimensionally stable platform along with essentially all of the circuit components necessary for operation of the fixture in both normal and emergency modes. The platform is preferably formed of a printed circuit board material due to the stability of such materials including resistance to warping and cupping inter alia. The platform is removably mounted to a supporting wall formed on a floor of the housing frame, the supporting wall being particularly configured to support the platform in a manner which reduces the possibility of warpage or other dimensional distortion of the platform. The dimensionally stable platform structure not only allows operationally effective mounting of the battery and interior circuit components at a desirable location within the interior of the fixture housing, the platform further mounts at least certain light sources such as an array of light emitting diodes in a particularly desirable location within the interior of the housing for effective illumination. The dimensional stability of the platform occasioned by material choice as well as by the supporting wall arrangement further enhances illumination levels since a flat, dimensionally stable platform as provided by the invention increases desirable internal reflection and contributes to greater uniformity of illumination of the indicia. Mounting of the battery, lamping and essential circuit components at or near the "floor" of the housing also provides an uncluttered interior space within the fixture housing which further facilitates the efficient use of available light. In such an uncluttered space, the reflective gains brought about by side walls and especially the upper wall of the housing are increased.

Mounting of the platform which supports the battery, lamping and essential circuit components at or near the "floor" of the housing, especially when provided with a diffusion cover according to certain embodiments of the invention, acts to protect against damage to the lamping and circuitry components as well as protecting against inadvertent touching thereof. A stronger overall structure and a more rigid overall structure is further provided by the fact that the platform in the form of a printed circuit board is snapped into place at a low elevation within the interior of the fixture, this mounting feature in combination with other structural elements producing greater strength/rigidity which would not otherwise be available with the reduced quantity of material, and thus wall thickness, used for formation of the fixture housing. In prior art plastic housings used with exit signs and the like, much thicker walls are employed in order to provide a necessary strength and rigidity to the overall fixture. With the substantial reduction of the quantity of plastic material used in the present fixtures, the benefits of greater plastic wall thicknesses as occurs in the prior art is not available and must be provided by structural elements which in combination provide the necessary strength and rigidity to the present fixtures.

The housing frame of the invention includes wire routing structure capable of unusual efficiency in managing wiring which must be routed within the interior of the housing, this structure facilitating placement of wires during initial wiring and maintenance of those wires in place once the fixtures are assembled. The inventive features of the present fixtures include particular embodiments of devices intended to handle such wiring and to maintain the wiring in place. Geometrically efficient wire handling structure takes the form of a tongue-like element extending into an opening of particular shape and dimension with relieved edge portions of the tongue and of structure defining the opening facilitating placement of wires and maintenance of those wires in a desired location.

The present invention further contemplates particular snap structures which hold the platform in place, the snaps having a "goose-neck" conformation comprised of a vertical body portion which remains stationary even during snap-fitting of the platform to the snaps and which is further comprised of a recurved distal portion which deflects during the snapping function. The particular structure of the present snaps eliminates creep and longterm fatigue in the plastic material from which the snaps are formed. In the present snap structures, the forces necessary to hold the platform in place are provided by a portion of the snap which does not deflect during snap-fitting of the platform into place within the fixture.

The invention further provides structure carried by the platform in at least certain embodiments of the invention which acts to snap-fit the battery into position to positively hold the battery in place on the platform and to electrically connect the battery into the circuitry carried by the platform. Prior to actual installation of the fixture, an insulating tab member prevents the battery from being a portion of system circuitry. On installation, the tab member is removed to connect the battery into system circuitry. The battery therefore does not require wiring into the circuitry during installation.

The combination of structural elements which synergistically act to provide strength and rigidity to the housing of the present fixtures take the form of tab-like stop elements which are provided on front and rear plates which snap-fit to the present housing frame, these elements preventing medial portions of upper and lower walls of the frame from being substantially deformed during assembly/disassembly or at any other time by virtue of the rigidity provided by said elements. These structural elements function in concert with other structure previously mentioned and structure which will be described in substantial detail hereinafter.

Other features of the present fixtures include simplified mounting structure formed integrally with the present frames to allow snap-fitting of accessories, such as DC emergency lamping, within the interior of the fixtures. Mounting of U-shaped accessory platforms to spaced snap-fit structure can also be accomplished through the use of this integrally formed snap mounting structure. This snap-fit mounting arrangement is exemplary of a number of relatively minor features which can be readily incorporated into the structure of the present housing frames for a given use requirement.

Accordingly, it is an object of the invention to provide lighting fixtures comprising illuminated signs and particularly exit signs having houses of substantial strength and rigidity, which housings are formed of polymeric materials with reduced wall thicknesses relative to prior art fixtures, the housings of the invention being structured for use in a variety of embodiments or versions capable of utilizing different light sources and differing sources of power, certain of the embodiments being "standard" and certain other embodiments being "emergency", both standard and emergency signage utilizing light sources including light emitting diodes or incandescent lamping in normal AC operation with emergency operation in those embodiments having emergency capability resulting from the use of light emitting diodes or incandescent lamping powered by DC battery power or by DC power supplied from externally of the fixture.

It is another object of the invention to provide lighting fixtures comprising illuminated signs and particularly exit signs having housings which can be substantially similar in structure regardless of the light sources and power sources employed, the housings comprising housing frames useful in the various embodiments of the invention, the frames being substantially similar in structure regardless of the light sources and power sources employed, the housing frames being further producible from a single mold which can be altered for elimination of unnecessary structural features when frames useful for particular embodiments of the invention are produced.

It is a further object of the invention to provide a lighting fixture comprising an illuminated sign and particularly an exit sign having light emitting diodes used as the illumination source with the light emitting diodes and circuit components necessary for operation of the light emitting diodes being mounted on a platform disposed and supported in a given portion of the sign which further increases not only the performance of the sign but also the strength and rigidity of the sign.

It is yet another object of the invention to provide a lighting fixture comprising an illuminated sign and particularly an exit sign having light emitting diodes used as the illumination source with at least one battery employed to operate the light emitting diodes in an emergency mode, the light emitting diodes, battery and circuit components necessary for operation of the light emitting diodes being all mounted on a platform disposed and supported in a given portion of the sign and particularly a lower portion of the sign to increase not only performance of the sign but also the strength and rigidity of the sign.

Further objects and advantages of the invention will become more readily apparent in light of the following detailed description of the preferred embodiments.

BRIEF DESCRIPTION OF THE DRAWINGS

FIG. 17 is a detailed perspective view of an upper corner portion of the housing frame of FIG. 16 illustrating inter alia the mounting of a lamp holder;

FIG. 18 is a detail elevational view in section of a portion of the mounting structure of FIG. 17;

FIG. 29 is a perspective view of a panel illustrating mounting features of the invention;

FIG. 30 is a section taken through lines 30—30 of FIG. 29; and,

FIG. 31 is a section taken through lines 31—31 of FIG. 29 in association with a phantom rendering of a protion of the frame to illustrate mounting of the panel to the frame.

DESCRIPTION OF THE PREFERRED EMBODIMENTS

Figure 1:
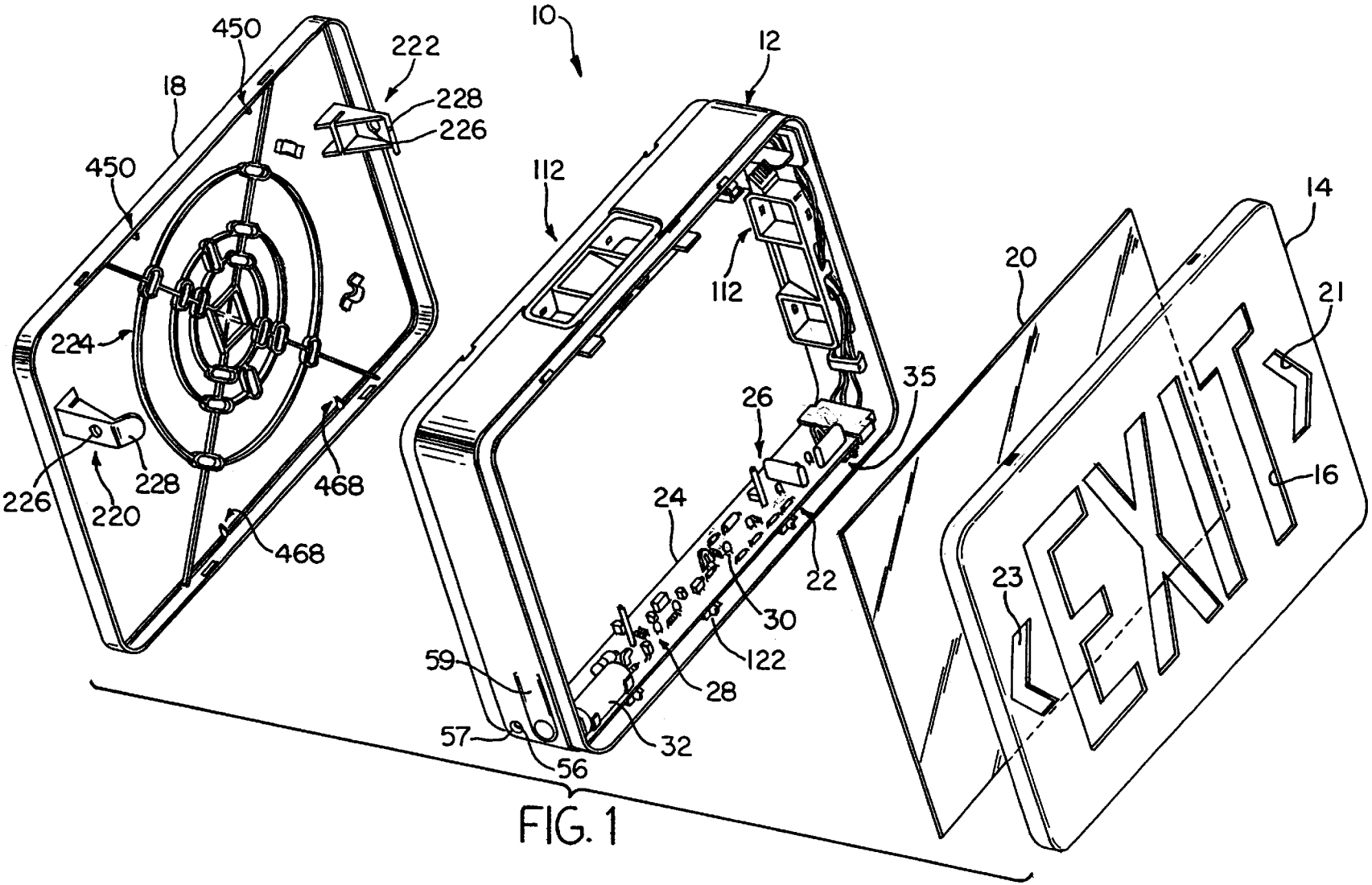
FIG. 1 is an exploded perspective view illustrating the primary components of an emergency lighting fixture configured according to a particular embodiment of the invention.
Figure 2:
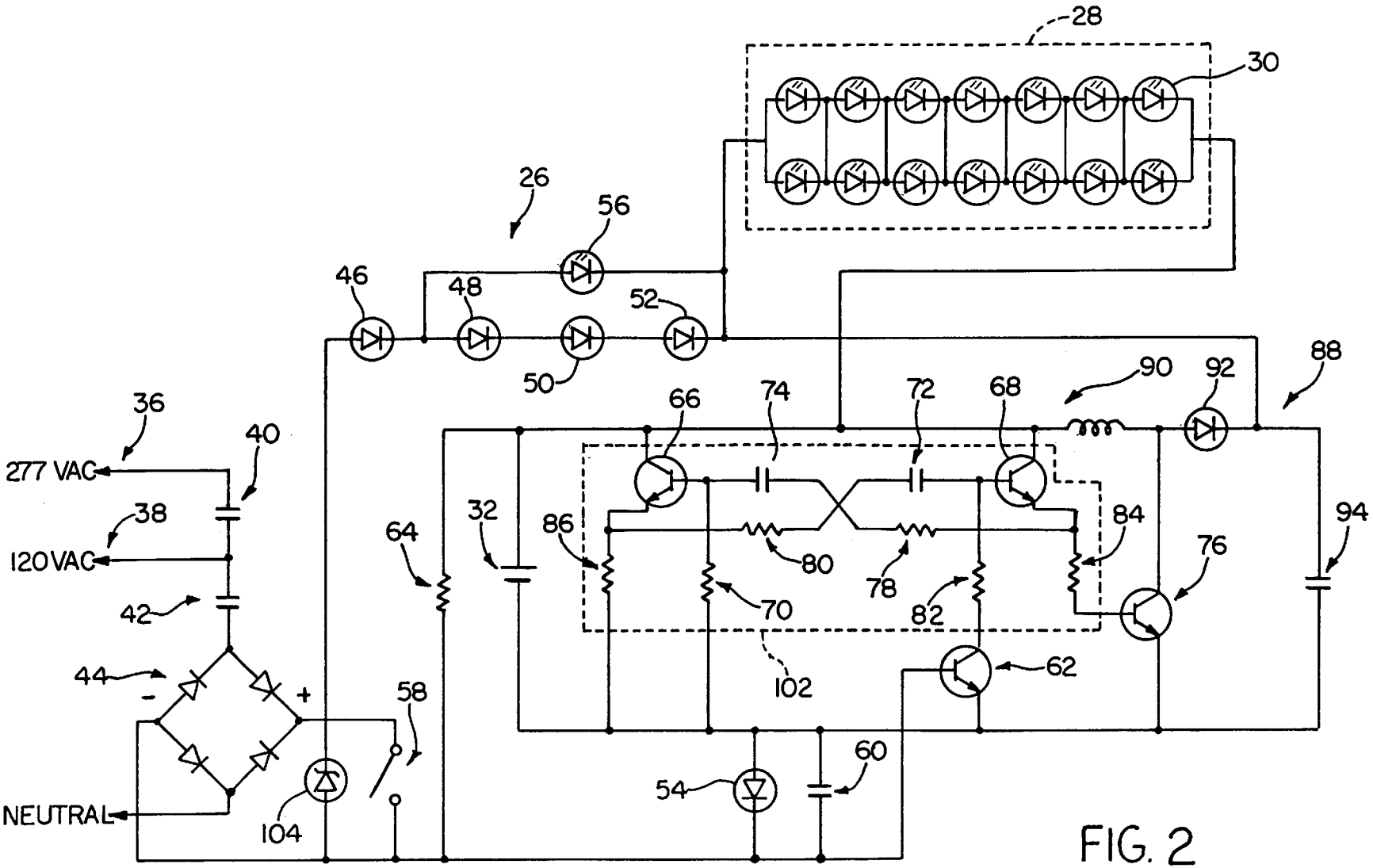
FIG. 2 is a block diagram of a particular circuit employed in the embodiment of the invention shown in FIG. 1 inter alia.
Figure 3:
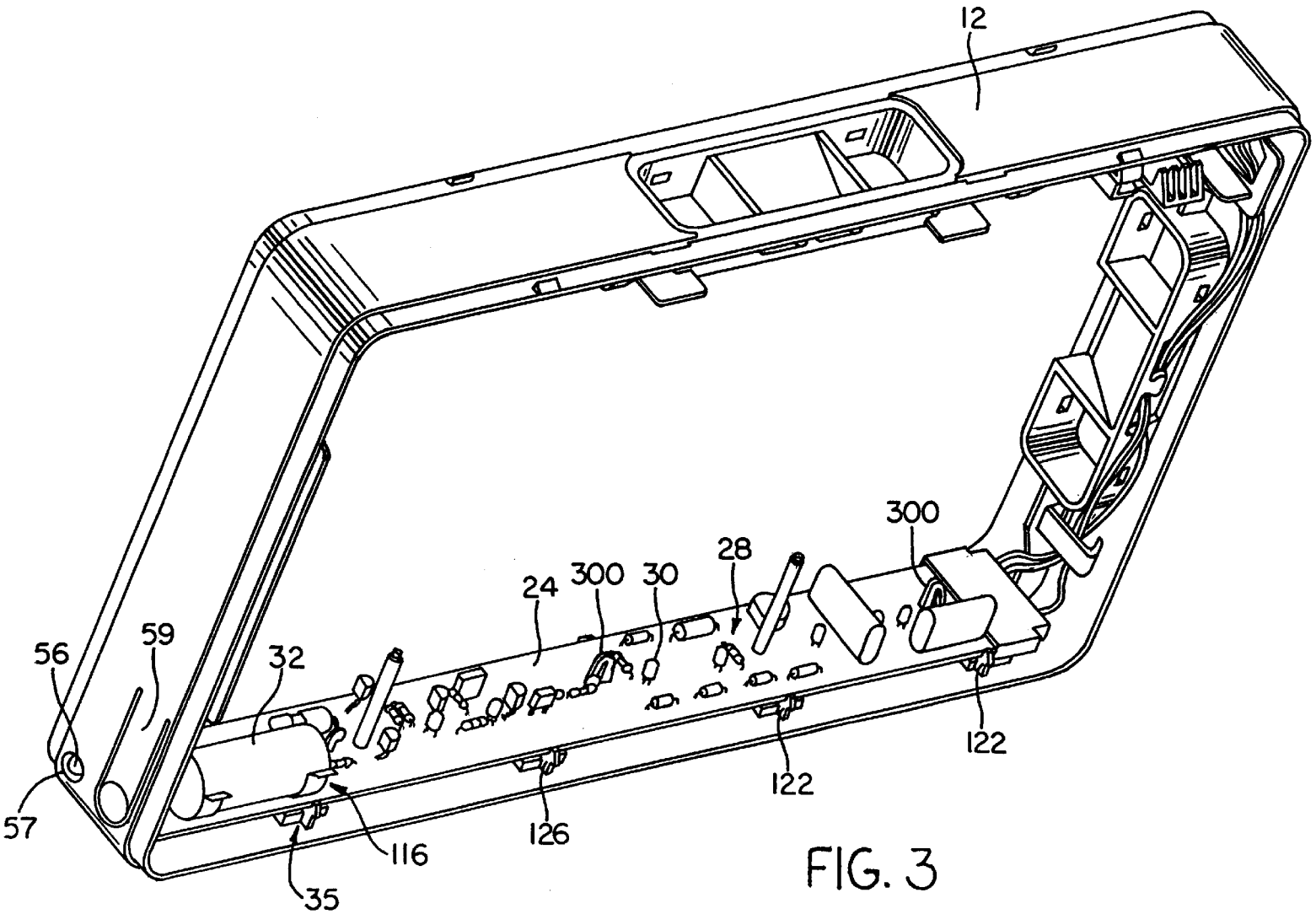
FIG. 3 is a perspective view of the housing frame configured in one embodiment of the invention to utilize an array of light emitting diodes as the illumination source for both normal and emergency operation, the figure particularly illustrating placement of the array of light emitting diodes, a battery and circuit components for operation of the light emitting diode array on a printed circuit board substrate.

Referring now to the drawings, and particularly to FIGS. 1, 2 and 3, an illuminated sign according to one embodiment of the invention is seen to take the form of exit sign 10 which comprises a housing frame 12, a front cover plate 14 having indicia 16 formed therein, a rear mounting plate 18 and a sign panel 20 mounted to the front cover plate 14 to provide background for the indicia 16. The housing frame 12 having the plates 14 and 18 mounted thereto essentially comprises the housing structure of the exit sign 10. It is to be understood that the rear mounting plate 18 can be removed and substituted for with a plate essentially identical to the front cover plate 14 in those versions of the exit sign 10 wherein the sign 10 is top mounted or side mounted and a lighting fixture is desired having indicia such as the indicia 16 on both major faces. In a direct wall-mounted installation, the rear mounting plate 18 is necessary in order for the sign 10 to be mounted directly to a wall in a manner which is described in detail in United States patent application Ser. No. 08/561,956, now U.S. Pat. No. 5,767,673, which patent is referred to hereinabove and the disclosure of which is incorporated hereinto by reference. The rear mounting plate 18 differs from the corresponding structure of Ser. No. 08/561,956, now U.S. Pat. No. 5,797,673, only in a few particulars as will be described in detail hereinafter. It is to be understood, however, that the rear mounting plate 18 could take the form of a simple panel or a panel essentially identical to the plate 14 if a direct wall-mounted installation is not intended.

The front cover plate 14 is typically provided with chevron-shaped openings 21 which also have the sign panel 20 as background. The openings 21 provide directional indication of the existence of an egress path. When one or both of the openings 21 are inappropriate to a particular location of the exit sign 10, a snap-fitting chevron plate 23 is inserted into one or both of the openings 21 to provide a light-tight fitting which eliminates said one or both of the openings 21 as a means for directional indication. The snap-fitting plates 23 can be rapidly and positively mounted into the openings 21 without the requirement for gaining access into the interior of the exit sign 10. While various chevron-shaped plates can be utilized, a particularly suitable structure is disclosed in U.S. patent application Ser. No. 08/327,487, now U.S. Pat. No. 5,611,163 which patent application is referred to hereinabove and incorporated hereinto by reference. As is described in detail in Ser. No.

U.S. Pat. No. 5,611,163, a placement of one of the chevron-shaped plates into one of the chevron-shaped openings 21 prevents light generated interiorly of the exit sign 10 from passing through the opening 21 which is so covered. In certain installations wherein the exit sign 10 may be placed directly over a doorway or the like, it is possible that both of the openings 21 will be blocked out to prevent misinterpretation of an intended directional indication during emergency conditions. Certain other installations may require that both of the openings 21 must remain open to provide directional indications such as in an installation signalling that a path of egress exists to both sides of the sign 10.

Interiorly of the sign 10 and mounted to a lower interior wall 22 of the housing frame 12 is a platform 24 which preferably takes the form of a printed circuit board to which circuit 26 is mounted. The platform 24 is preferably formed of printed circuit board stock in order to facilitate mounting of the circuit 26 to the platform 24 and in order to gain the benefits of the dimensional stability and other favorable characteristics of printed circuit board material. The circuit 26 comprises an array 28 of light emitting diodes 30 and includes a battery 32 for operation of the array 28 in an emergency mode when AC mains power is unavailable for operation of the array 28. The circuit 26 of FIG. 2 is seen in FIGS. 1 and 3 to be totally mounted on the platform 24 in a compact conformation with the weight of the circuit 26 including the weight of the light emitting diodes 30 as well as the weight of the battery 32 being supported by the platform 24 which is in turn supported by a supporting wall 35 which can be seen only in a few locations in FIGS. 1 and 3 but which will be shown and described in detail hereinafter. Even though the assembly formed by the mounting of the circuit 26, light emitting diodes 30 and battery 32 on the platform 24 essentially combines the weight of all of the elements so named, the resulting assembly structure is compact in conformation and unusually light in weight and can be compactly fit within the interior of the housing frame 12 and thus within the interior of the sign 10. The exit sign 10 can therefore be formed with dimensions which are unusually small when compared to a prior art exit sign having emergency capability.

In essence, the exit sign 10 is the first "small" emergency exit sign having a battery such as the battery 32 disposed interiorly of the sign housing. As configured for commercial use, the sign 10 is dimensioned to be of a size typically associated with a simplified standard exit sign which would typically not be capable of emergency operation and particularly not capable of emergency operation through use of a battery housed by the exit sign. The present exit sign, whether configured as standard or emergency versions, exhibits minimum weight and size and is characterised by housings formed of polymeric material or "plastics" wherein wall thickness is substantially reduced relative to prior art emergency exit signs formed of polymeric materials. By so forming the housings of the present exit sign 10, the amount of polymeric material necessary to manufacture said housing is substantially reduced, thereby providing a substantial cost savings. Since wall thicknesses are reduced relative to heavier prior art wall thicknesses, the present exit signs 10 do not enjoy the strength and rigidity benefits normally obtained with greater wall thickness. For this reason, the present exit signs 10 particularly employ structural elements which in combination provide "synergistic" benefits as to housing strength and rigidity and essentially allow production of an exceptionally low-cost illuminated sign having a housing capable of supporting lamping, circuitry and an emergency power source as is described in detail herein.

The operation of the circuit 26 shown in FIG. 2 is described in substantial detail in U.S. patent application Ser. No. 08/675,109, filed Jul. 3, 1996, now U.S. Pat. No. 5,739,639, this patent being referred to hereinabove and incorporated hereinto by reference. Reference is made to Ser. No. 08/675,109, U.S. Pat. No. 5,739,639, for a description of FIG. 2 and certain circuit portions shown in FIGS. 1 and 3. The numerals used to refer to the circuit 26 in the aforesaid patent application are also seen in FIGS. 1 through 3 of the present patent application and for the most part will not be repeated herein except as necessary for reference to structure described herein.

The circuit 26 is representative of the several circuits disclosed in Ser. No. U.S. Pat. No. 5,739,639 and finds particular utility in the exit sign 10 of the present invention. In particular, the circuit 26 essentially allows use of an unusually small battery, such as the battery 32, thereby resulting in a substantial weight reduction which inter alia allows mounting of the array 28, the battery 32 and major components of the circuit 26 to the platform 24 in a compact and efficient manner. The platform 24 can then be mounted in a desired location within the exit sign 10 and particularly to the supporting wall 35 formed along the "floor" of the housing frame 12, that is, the interior wall 22, such that the interior space within the exit sign 10 is essentially vacant and allows for reflection of light from the array 28 against interior side walls as well as interior top wall surfaces of the housing frame 12. Illumination levels within the interior of the exit sign 10 are essentially maximized for a given light output from the array 28. In order to maximize light output through the indicia 16, the light emitting diodes 30 selected to comprise the array 28 are taken to be light emitting diodes which are characterized by relatively high light output. Light distribution within the interior of the exit sign 10 is further improved by maintaining the platform 24 in a flat configuration. The supporting wall 35 which will be described in detail hereinafter provides support necessary to prevent warping, bowing, cupping, etc. over time which might otherwise occur due to temporal degradation, temperature degradation or the like. Dimensional distortion of the platform 24 is believed to be capable of causing inefficient light distribution through the indicia 16 when such indicia 16 is provided either on one face or on both faces of the exit sign 10.

The light emitting diodes 30 can be selected from a variety of suitable diodes such as the "blue" light emitting diode manufactured by Nichia Chemical Industries, Ltd., of Tokyo, Japan, these diodes being particularly useful for production of a green legend when viewed from exteriorly of the sign 10. When "blue" light emitting diodes are employed, a transformation material is provided in the sign panel 20 as is taught in copending U.S. patent application Ser. No. 08/471,83, filed Jun. 7, 1995, now U.S. Pat. No. 5,640,792 and entitled "Lighting Fixtures", which is assigned to the present assignee with the disclosure thereof being incorporated hereinto by reference. When using light emitting diodes of the relatively non-diffuse, narrow-viewing angle type, a diffuser structure as is described herein can be usefully employed. The "red" light emitting diode produced by Koteco under the designation SR3511-U and being formed of GaAlAs/GaAs can be used as the diodes 30 to form a red legend in a manner known in the art.

Figure 7:
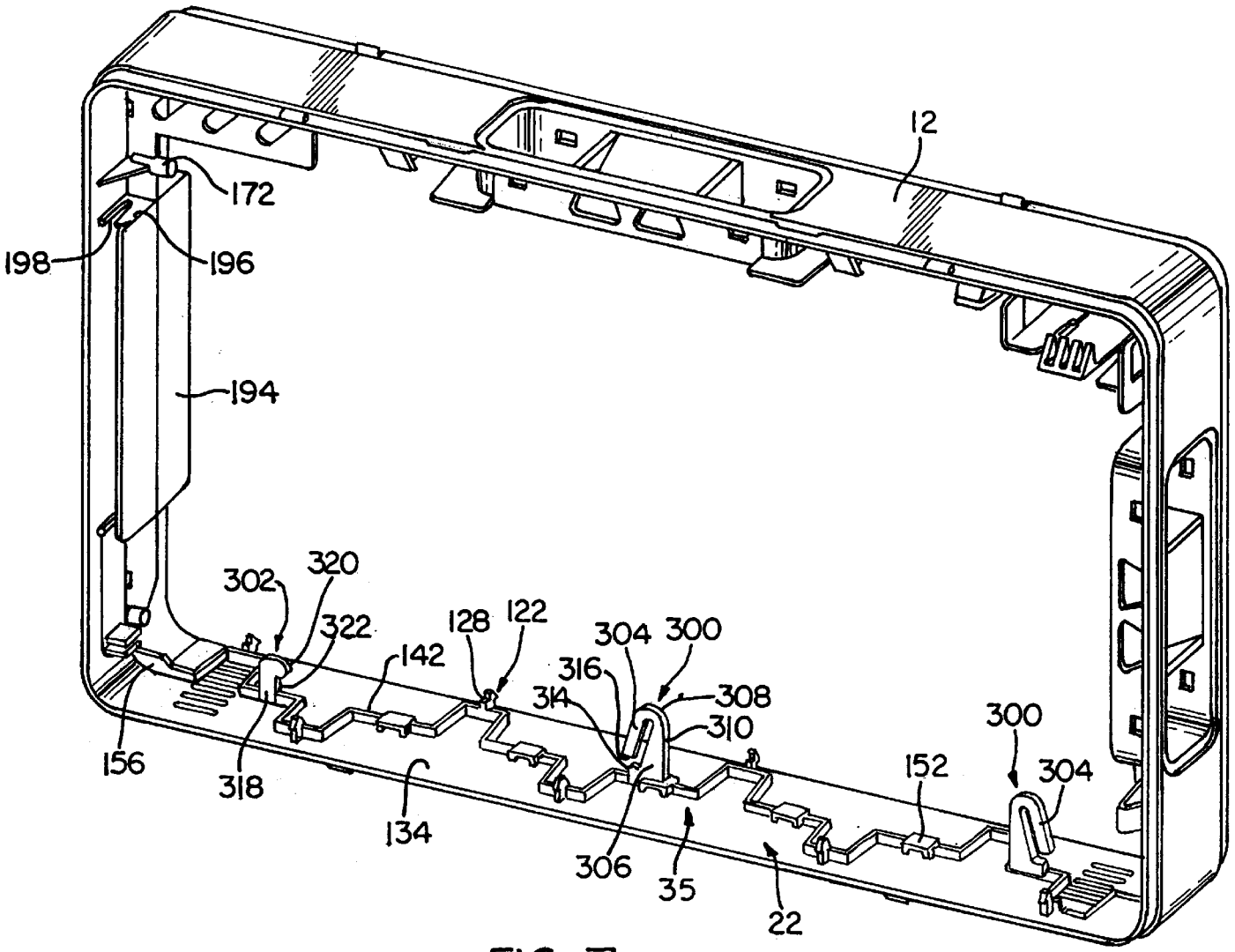
FIG. 7 is a perspective of the housing frame of FIG. 3 taken from a differing point of view.
Figure 8:
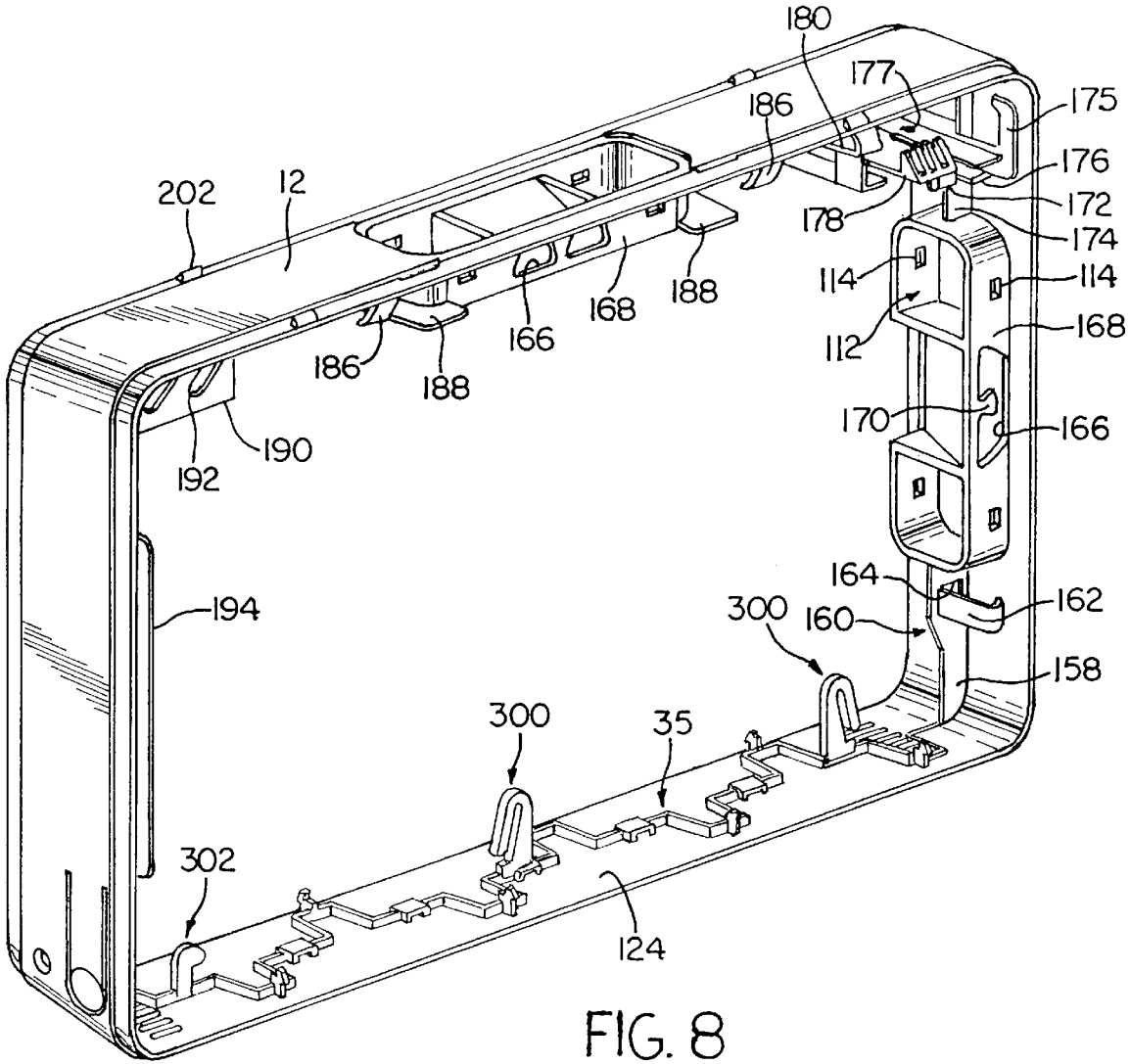
FIG. 8 is a perspective view of the housing frame taken from yet another point of view.
Figure 16:
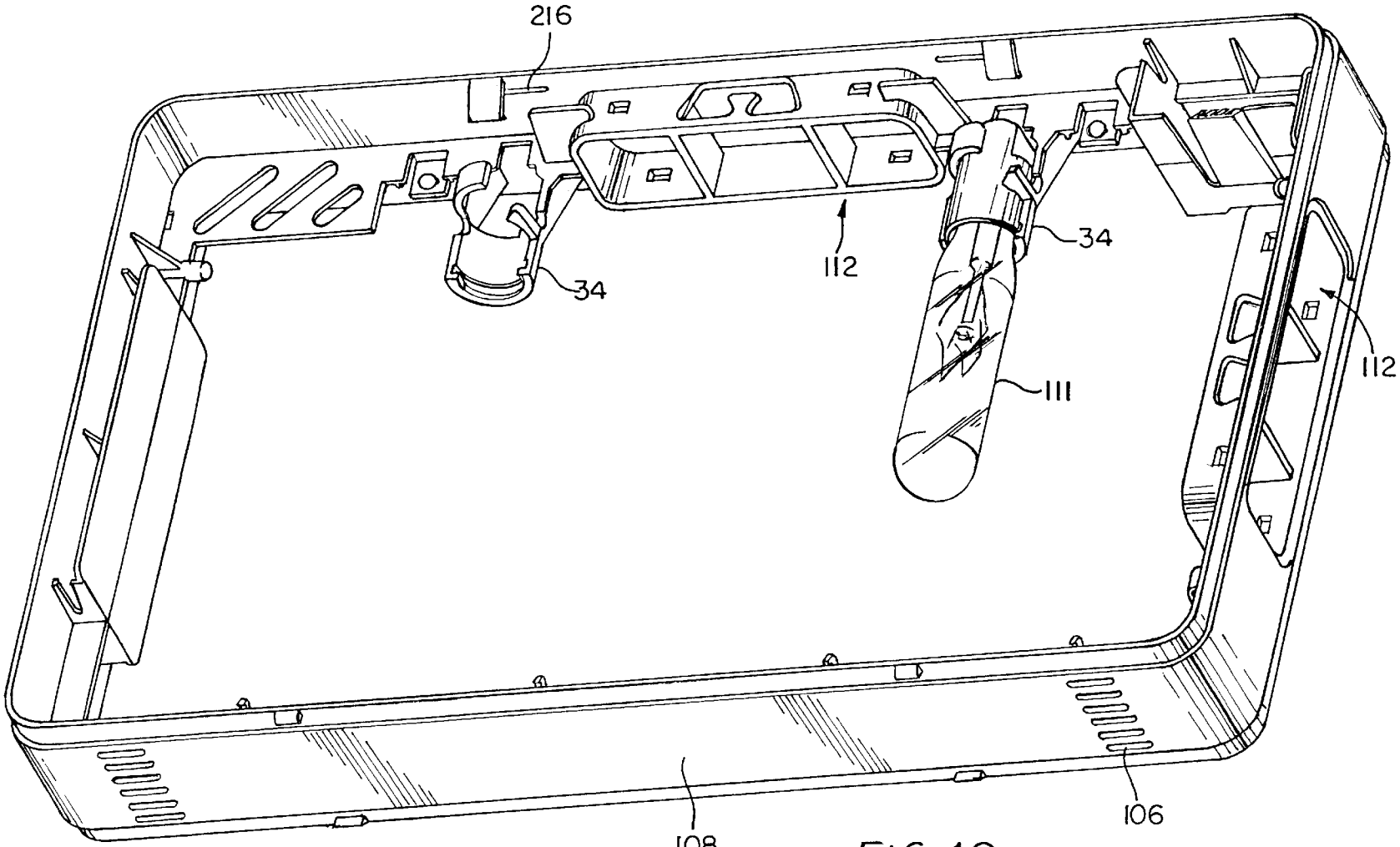
FIG. 16 is a perspective view of the housing frame configured according to incandescent standard and incandescent emergency embodiments of the invention.
Figure 20:
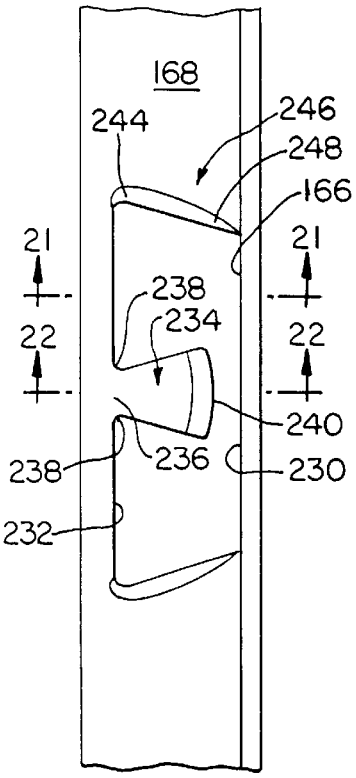
FIG. 20 is a plan view of the wire management device.
Figure 19:
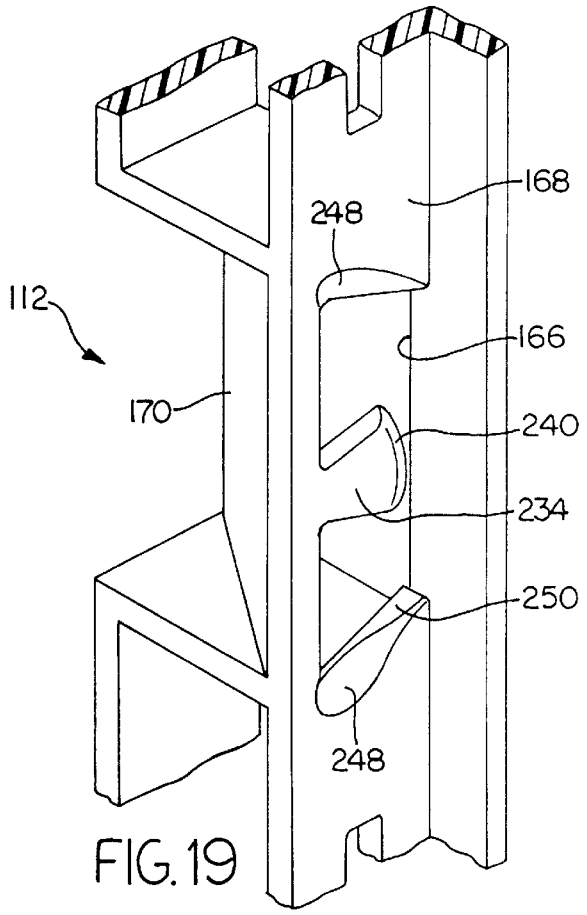
FIG. 19 is a detail perspective view of a wire management device configured according to the invention.
Figure 21:
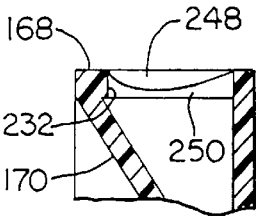
FIG. 21 is a section taken along lines 21—21 of FIG. 20.
Figure 22:
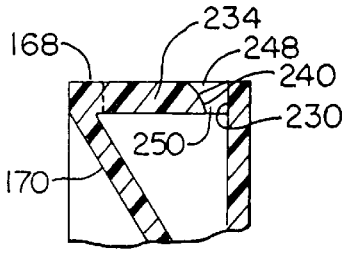
FIG. 22 is a section taken along lines 22—22 of FIG. 20.

The housing frame 12 is molded as a unitary structure capable of various modifications to remove certain structure which could otherwise be molded into the housing frame 12 but which is not necessary for use in certain embodiments of the present exit sign 10. A single mold can be used to form the housing frame 12 and modifications can be made simply within such a mold (not shown) to remove structure such as AC lamp holders 34 (seen in FIGS. 16 through 18) which are not needed for operation of the embodiment of the invention seen in FIG. 1 inter alia. The mold (not shown) used to form the housing frame 12 can also be quickly and easily configured to remove aperture 57 and test switch actuator 59 from the housing frame 12 of FIG. 1 when the housing frame 12 is modified for other embodiments of the invention including incandescent versions thereof. The embodiment of the invention shown in FIG. 1 inter alia which utilizes the array 28 of light emitting diodes 30 for both normal operation and for emergency operation does not need to have vent openings 106 as does an incandescent version such as is seen in FIGS. 16 through 18. It is possible to allow unnecessary structure such as the AC lamp holders 34 of FIG. 16 to remain in the embodiment of the invention shown in FIG. 1 inter alia. In fact, aforementioned Ser. No. 08/561,956, U.S. Pat. No. 5,797,673 shows AC lamp holders 34 (the numeral 34 also being used to describe AC lamp holders in the aforementioned patent) although the holders 34 have no function within a configuration of the exit sign 10 such as is described in FIG. 1 inter alia of the present patent application and in the exit sign described and claimed in U.S. Pat. No. 5,797,673. More efficient light distribution can be seen to occur in the exit sign 10 of FIG. 1 inter alia when the AC lamp holders 34 are not molded into the housing frame 12 for the "all-LED" embodiment intended. Code requirements also come into play in formation of housing frames such as the frame 12 when considering differing embodiments and modifications including choice of illumination source or power source or both. Openings in the housing frame 12 of FIG. 7 inter alia such as the vent openings 106 of FIG. 16 inter alia are not necessary but can provide manufacturing function. The exit sign 10 of FIG. 1 inter alia would not require vent openings for thermal purposes since little heat is generated within the single cavity of the exit sign 10 of FIG. 1. When considering the embodiment of FIG. 16 inter alia, incandescent light sources as will be described hereinafter generate substantial heat which must be vented by means of the vent openings 106 inter alia as will be described. Since the embodiment of FIG. 16 as shown does not contain a battery, the aperture 57 through which the indicator light emitting diode 56 extends and the test switch 58 and test switch actuator 59 are not necessary and can therefore be eliminated during the molding process in the formation of housing frame 108 as seen in FIG. 16. It is to be understood, however, that the housing frames of the invention including the housing frame 12 and the housing frame 108 are extremely similar in construction and can be formed from the same mold. Certain structure can be retained in essentially all embodiments of the housing frames when the retained structure can function to provide at least stability and strengthening of the frames and/or when the retained structure would be difficult to remove in the molding process. As an example, the supporting wall 35 is typically retained for strength and rigidity in the housing frames of the invention even though the supporting wall 35 is not necessary for mounting of the platform 24 in those embodiments of the invention which do not employ light emitting diodes as an illumination source.

It is of importance to again observe that the exit sign 10 of FIG. 1 inter alia comprises a particular embodiment of the invention wherein the circuit 26 is of particular utility due to the ability of said circuit 26 to be compactly configured and disposed along with the array 28 of light emitting diodes 30 and the battery 32 on the platform 24, thereby providing an exceedingly compact and light weight illumination system having particular cost effectiveness due to the ability of the circuit 26 to operate the array 28 in both emergency and non-emergency modes. Still further, the size of the exit sign 10 can be substantially reduced in part due to the compact and light-weight nature of the circuit 26 including the battery 32 and the remaining components of the circuit 26 as described herein and in U.S. Pat. No. 5,739,639.

Figure 14:
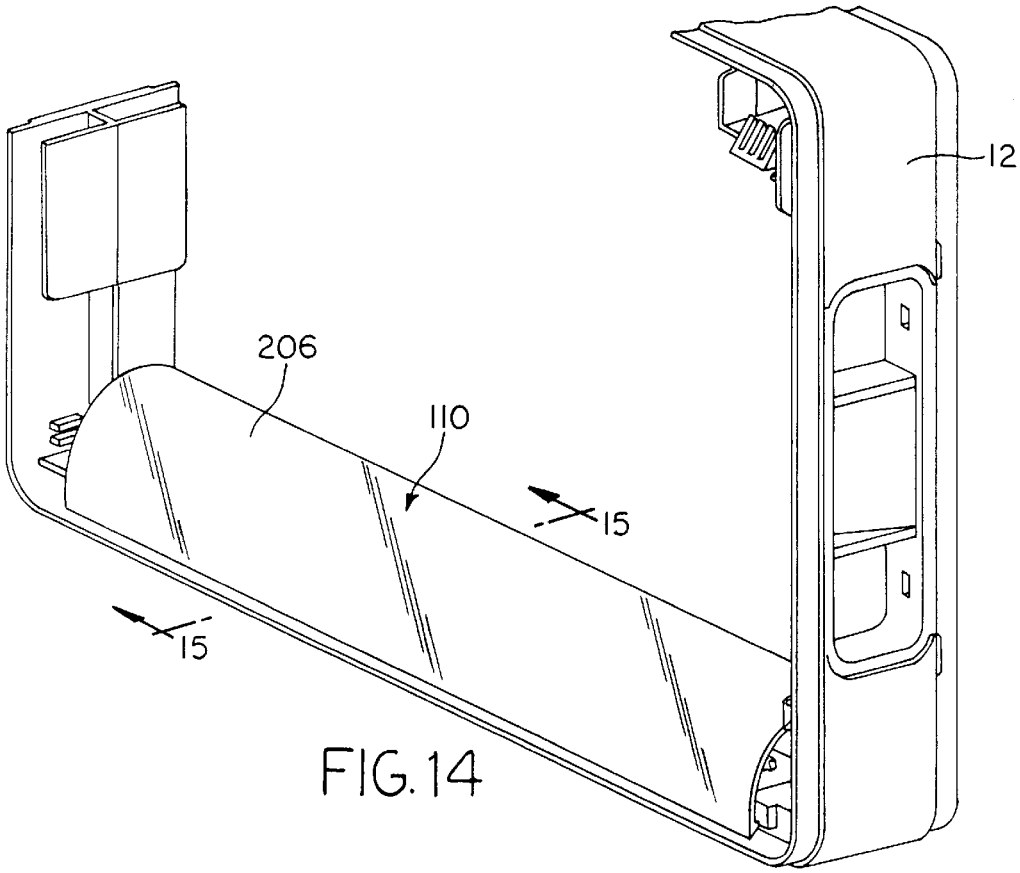
FIG. 14 is a perspective view of an embodiment of the invention utilizing a cover for protection of a printed circuit board platform carrying a light emitting diode array, a battery and circuit components on said platform.
Figure 15:
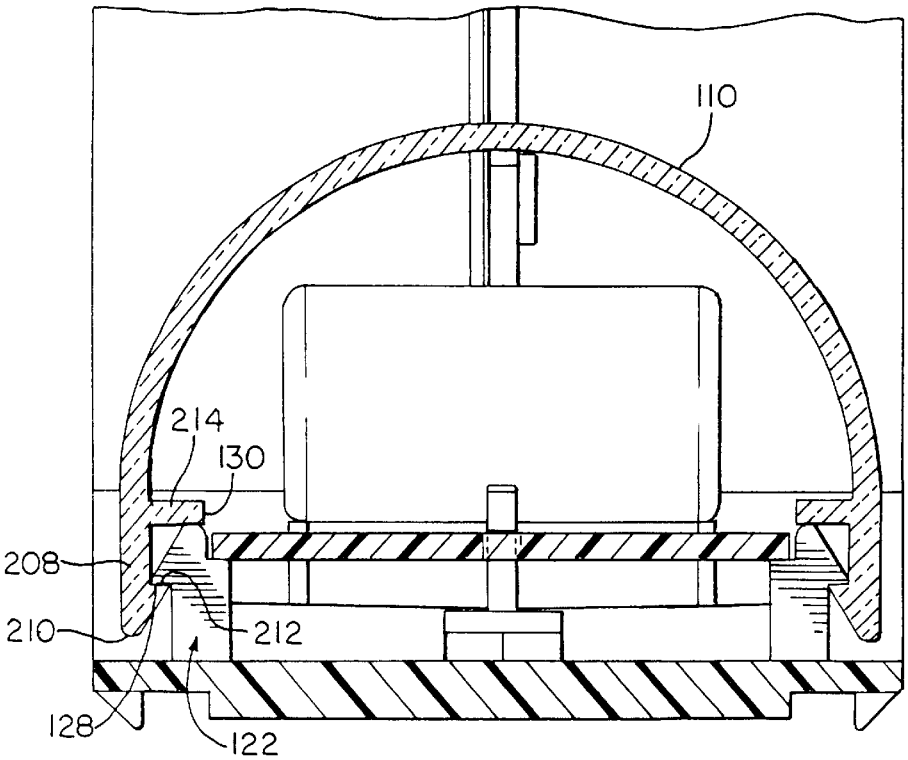
FIG. 15 is a side elevation in partial section taken through line 15—15 of FIG. 14.

A number of configurations or versions of exit signs can be formed according to the invention through the use of housing frames whch are essentially identical to each other except for minor modification which can take place in the process of molding said frames. Exit sign housings are then formed with the housing frames of the invention as primary structural elements which are completed by the snap-fastening of cover plates such as the plates 14 and 18 to said housing frames, thereby providing enclosed housings. A primary embodiment of the invention is the "version" shown particularly in FIG. 1 inter alia. This embodiment of the invention has already been described relative to FIGS. 1 and 3 in particular and is a preferred configuration of the invention. The exit sign 10 of FIG. 1 inter alia utilizes the array 28 of light emitting diodes 30 for normal illumination operable with AC mains power and emergency illumination through direct current provided by the battery 32. Accordingly, the same light emitting diodes 30 provide the illumination source in both normal and emergency modes. As noted above, the exit sign 10 of FIG. 1 inter alia is an exit sign of the "emergency" type since it is capable of operation both under non-emergency conditions and emergency conditions. The housing frame 12 of the exit sign 10 is not provided with vent openings such as the vent openings 106 of the housing frame 108 shown in FIG. 16 for reasons already given. Further, the housing frame 12 is not provided with AC lamp holders such as the holders 34 of FIG. 16. The exit sign 10 is provided with the test switch actuator 59 as well as the aperture 57 through which the indicator light emitting diode 56 protrudes. The light emitting diodes 30 used in the exit sign 10 can take the form of "blue" light emitting diodes or red light emitting diodes inter alia. When "blue" light emitting diodes are utilized as aforesaid, the sign panel 20 is coated with, preferably on an inner face thereof, or contains a material which can be referred to as a transformation material which is excited by light in a blue wavelength band emitted by the "blue" light emitting diodes to cause radiation from the panel 20 exiting the sign 10 through the indicia 16 to be of a green color, green being one preferred color of light desirable for viewing through the indicia 16 as well as the openings 21 of the plate 14. Disclosure pertinent to the use of blue light emitting diodes to provide a green color perceived from externally of the exit sign 10 is provided in U.S. patent application Ser. No. 08/471,820, now U.S. Pat. No. 5,640,792, referred to above and incorporated hereinto by reference. When using blue light emitting diodes, it is preferred to provide a cover 110 as seen in FIGS. 14 and 15 over the platform 24 so that light from the light emitting diodes 30 is diffused. The cover 110 further provides protection for those structural elements located on the upper face of the platform 24 and could accordingly be used for protective purposes even when blue light emitting diodes are not used as the diodes 30. The mounting of the cover 110 to the platform 24 will be described hereinafter relative to FIGS. 14 and 15.

When using "red" light emitting diodes as the diodes 30, the sign panel 20 can take the form of a simple diffusion panel. Alternatively, the panel 20 can be provided with a coating such as could be formed of a conventional material which would pass red light of a wavelength similar to the wavelength emitted by the "red" light emitting diodes. The panel 20 so provided with such a material, preferably on an inner face thereof, acts to produce a more "lively" appearance of the light passing through the indicia 16 and through the openings 21 formed in the plate 14. As aforesaid, a cover such as the cover 110 need not be provided over the platform 14 when red light emitting diodes are utilized as the diodes 30 since diffusion of light from red light emitting diodes is usually not necessary. However, the cover 110 could be provided as an option for protective purposes.

An emergency version of the exit sign 10 can alternatively be provided utilizing the housing frame 12 and associated structure necessary to provide a housing for such an exit sign. In particular, an emergency exit sign (not shown) which can be powered in the emergency mode through direct current supplied from externally of the exit sign can be readily fabricated. Emergency DC power can be provided to the light emitting diodes providing the illumination source in both normal and emergency modes by means of systems such as is disclosed in U.S. patent application Ser. No. 08/165,199, referred to hereinabove and the disclosure of which is incorporated hereinto by reference. In such a "version" of the invention, a battery is not provided for emergency power. Accordingly, a test switch is not provided and the aperture 57 formed in the housing frame 12 is not necessary since an indicator light emitting diode such as the diode 56 of FIG. 1 inter alia is not necessary to indicate charge on a battery. Light emitting diodes such as the such as the diodes 30 of FIG. 1 inter alia are provided on a platform such as the platform 24 and circuitry (not shown) used for operation of the light emitting diodes can also be located on such a platform. This platform (not shown) would be supported within the interior of such an exit sign in a manner essentially identical to that described relative to the exit sign 10 of FIG. 1 inter alia The use of light emitting diodes of differing colors along with diffusion covers or lack thereof and transformation material applied to sign panel structure such as the sign panel 20 of FIG. 1 can also be utilized in this "all-light emitting diode" emergency version of the invention which differs primarily from the exit sign 10 in the use of DC emergency power provided from externally of the sign.

Figure 4:
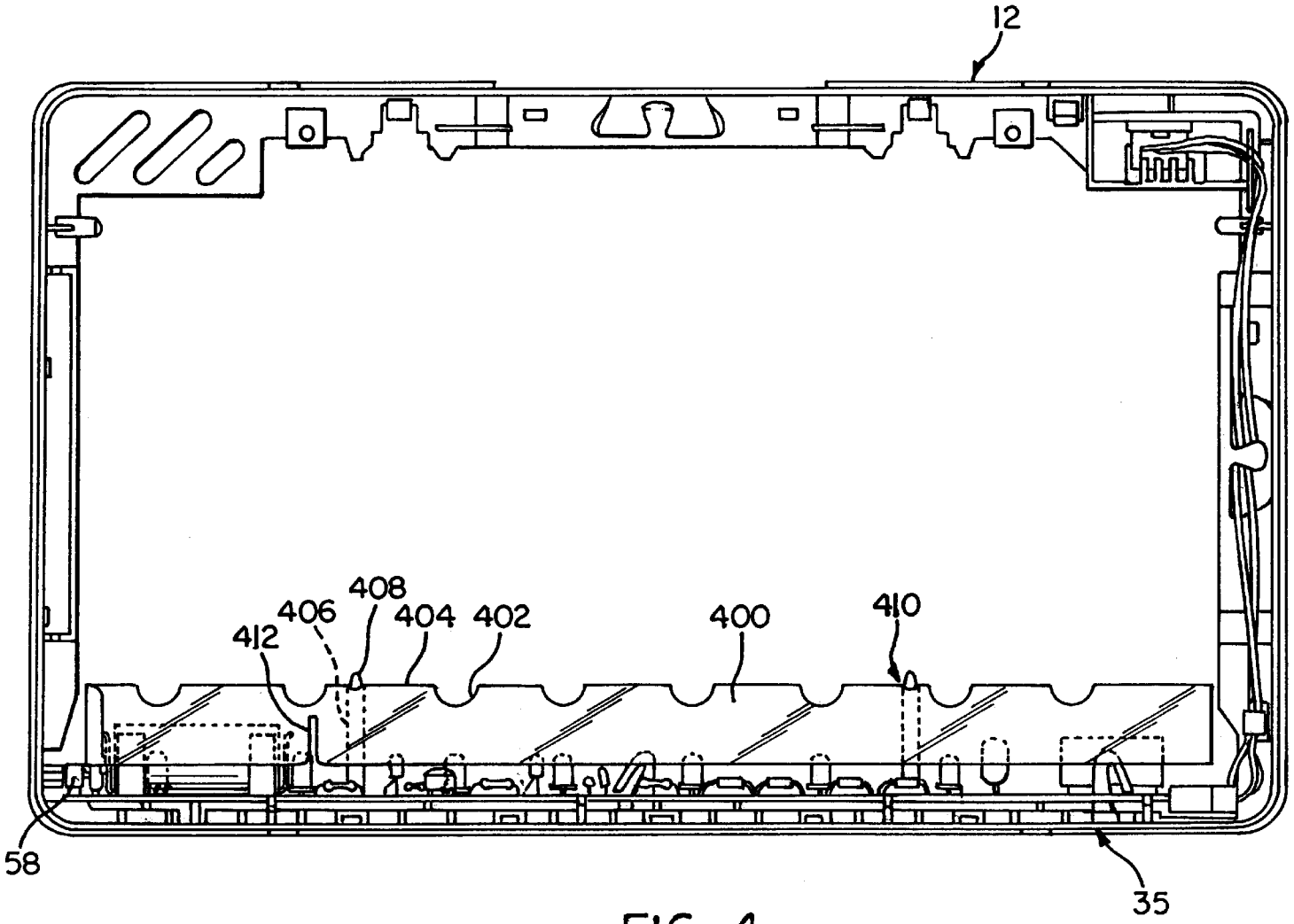
FIG. 4 is a front elevational view of a housing frame of the invention in the embodiment of FIG. 3 and additionally having a diffuser structure and mounting arrangement.
Figure 5:
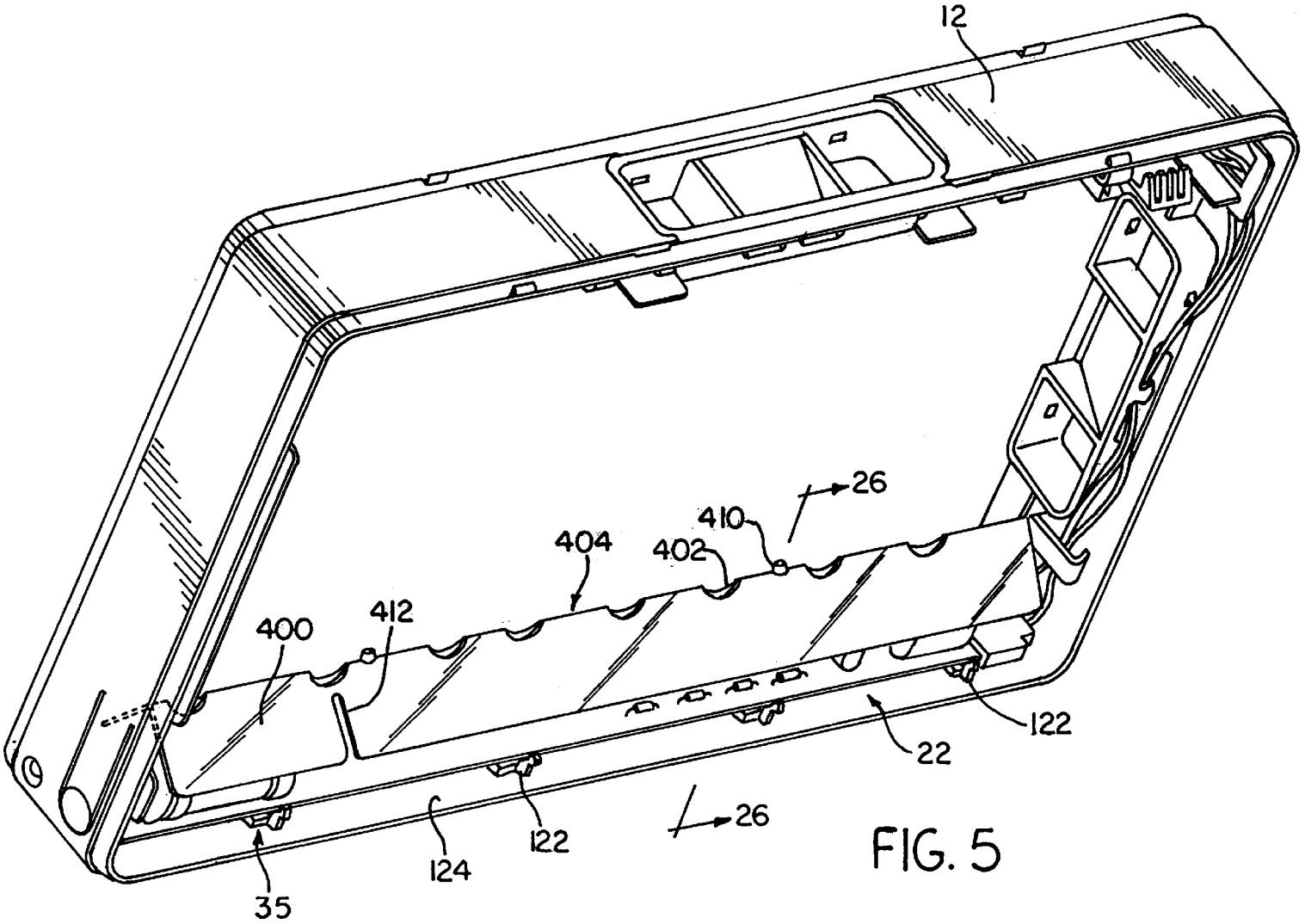
FIG. 5 is a perspective view of the housing frame of FIG. 4 as seen from a position to the side of and above the housing frame.
Figure 26:
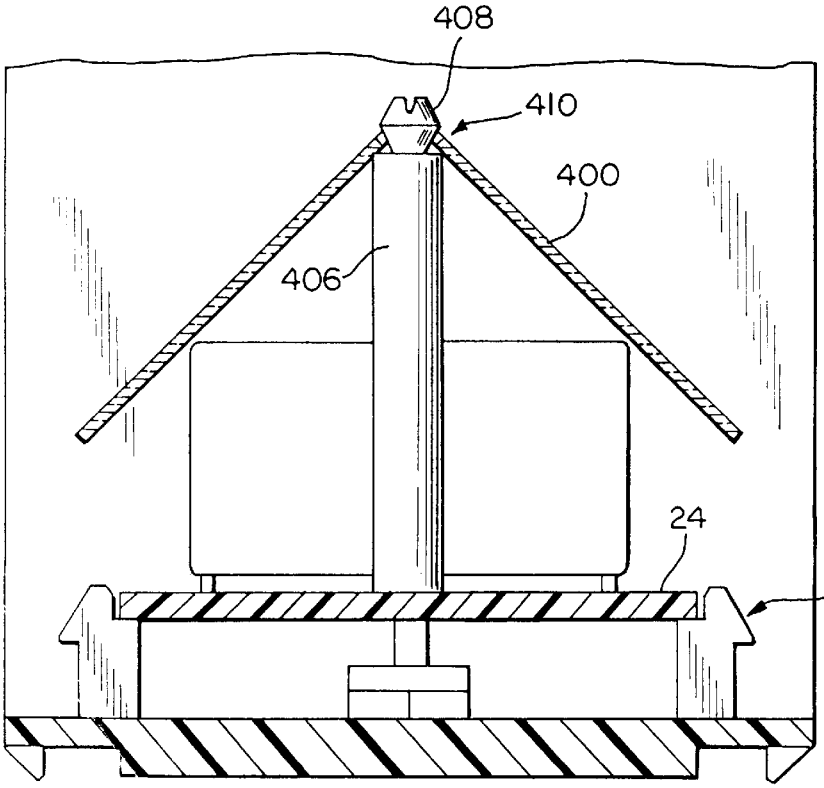
FIG. 26 is a section taken along lines 26—26 of FIG. 5.

Yet another light emitting diode version of the invention which is similar to the exit sign 10 and utilizes the housing frame 12 can be formed with an array of light emitting diodes disposed on a platform such as the platform 24 of FIG. 1 inter alia, such a version being a "standard" exit sign having no emergency operation. Accordingly, DC power is not provided to light emitting diodes in this "standard" version of the invention. This "version" of the invention, which is not shown, does not include a battery or test switch, etc., as is described relative to the version of the invention described immediately above. However, a platform such as the platform 24 of FIG. 1 inter alia is provided for mounting of a light emitting diode array and the circuitry used for operation of such an array. Light emitting diodes of differing colors as described above can also be used in this "standard" version of the invention with covers such as the cover 110 referred to above or a diffuser as shown in FIGS. 4, 5 and 26 being optionally usable with other embodiments of the invention. Similarly, transformation material can be coated onto a sign panel such as the sign panel 20 of the exit sign 10 for those purposes described hereinabove.

Exit signs configured with housing frames such as the housing frame 12 of FIG. 1 inter alia can also be provided with incandescent light sources. A "standard" version which is not expressly shown herein utilizes AC lamping for normal operation. A "standard" exit sign of this type would provide no emergency operation and therefore would not necessitate the use of lamping operable through direct current emergency power. Such a "standard" version would be provided with vent openings such as the vent openings 106 formed in the housing frame 108 as shown in FIG. 16 as aforesaid, these vent openings being necessary for ventilation to remove heat generated by AC lamping. The AC lamp holders 34 also seen in FIGS. 16 and 17 as aforesaid would be provided with this "standard" version of the invention for mounting of AC incandescent lamping. Such a version of the invention would essentially utilize the housing frame 108 of FIG. 16 but without a test switch, test switch actuator or aperture such as the aperture 57 shown in FIG. 1 since no need would exist to test a battery in this incandescent "standard" version of the invention. While no platform such as the platform 24 of FIG. 1 inter alia would be necessary in this incandescent "standard" version, a supporting wall such as the supporting wall 35 would remain as a part of the housing frame 108 for reasons of convenience and strengthening of the frame as indicated above. Power provided to an incandescent "standard" version of the invention would be provided by AC mains power supplied from externally of such a sign and would be brought into the interior of such a sign through wire conductors as is conventional in the art.

The embodiment of the invention particularly shown in FIGS. 16 through 18 comprises an incandescent "emergency" exit sign having the housing frame 108 as the primary structural feature of a housing configured according to this "version" of the invention. Incandescent AC lamping 111 is mounted in this version of the invention in the AC lamp holders 34 for normal operation with DC lamping 113 seen in FIG. 17 being driven by DC power supplied from a source external of the housing frame 108. Reference is made to U.S. patent application Ser. No. 08/561,956, referred to hereinabove and incorporated hereinto by reference for a description of the AC lamp holders 34 and the AC lamping 111. The mounting of the DC lamping 113 on the housing frame 108 will be described hereinafter. The "version" of the invention shown in FIGS. 16 through 18 would not require the use of a battery, test switch, LED indicator aperture or platform such as the platform 24 of FIG. 1 inter alia. However, a supporting wall such as the wall 35 of FIG. 1 inter alia would be retained on the housing frame 108 for reasons such as are given hereinabove. In this incandescent emergency "version" of the invention, circuitry interior of the exit sign is not necessary since both alternating current and direct current necessary for normal and emergency operation is brought in from externally of the exit sign and only electrical conductors necessary for these functions are required as in a manner conventional in the art. A fire alarm interrupt circuit can be used with both standard and emergency versions of the invention although this structure is not shown in the drawings. Such an interrupt circuit is mounted on a circuit board (not shown) which can be covered by a shrink wrap film and held by a wire tie (not shown) within the frame 108 until needed. A fire alarm interrupt circuit is essentially conventional in the art and need not be shown or described in detail herein.

While other versions of the invention which would utilize housing frames such as the housing frame 12 or the housing frame 108 could be recognized conceptually, the versions noted hereinabove are essentially those versions which are "commercial" and which find the greatest utility in actual use. It is to be understood that the housing frames used in the various embodiments of "versions" of the invention as described herein can be formed from the same mold, the mold being modified as referred to above such that certain unnecessary structure can be eliminated during the molding process.

Referring now again to FIGS. 1 and 3 inter alia, the housing frame 12 is seen to be provided with canopy mounting openings 112 with one each of the openings 112 being substantially centrally mounted respectively on the top and on one side wall of the housing frame 12. The housing frame 108 of FIG. 16 is provided with identical openings such as the openings 112. The openings 112 are provided for mounting of the exit sign 10 to a canopy (not shown) through canopy mounting structure (not shown) such as is described in detail in U.S. Pat. No. 5,526,251, referred to hereinabove and incorporated hereinto by reference. Rectangular apertures 114 formed in the openings 112 receive snap-fitting prongs (not shown) of a cover plate (not shown) used conventionally to cover one or both of the openings 112 when the openings 112 are not used for mounting of the exit sign 10 or other versions of the exit signs of the invention. As an example, both of the openings 112 of the housing frame 12 of FIG. 3 would be provided with a cover plate (not shown) in the event that the exit sign 10 is directly mounted to a wall through use of the rear mounting plate 18 as aforesaid.

In FIG. 3, the platform 24 can readily be seen to carry the battery 32, the array 28 of the light emitting diodes 30 as well as components of the circuit 26 as has been described hereinabove. FIG. 3 further provides illustration of a resilient battery clip mounting arrangement 116 which is also shown in detail in FIGS. 24, 25, 27 and 28 as will be described hereinafter in detail. Generally, clips 118 hold the battery 32 at either end thereof, the clips 118 being directly mounted to the platform 24. Electrical connection clip 120 electrically connects the battery 32 in a conventional manner into the circuit 26.

Referring particularly to FIGS. 3 and 6 through 9A, the supporting wall 35 can be seen in detail. In FIG. 3, only portions of the supporting wall 35 are seen since the platform 24 is disposed in place in surmounting relationship to the supporting wall 35. It is to be understood that supporting walls capable of providing the function of the supporting wall 35 can be configured otherwise than as is expressly shown. The supporting wall 35 has been found to exhibit particular utility and can be readily produced during the molding process which produces the housing frame 12. The geometrical configuration of the supporting wall 35 follows a parting line during fabrication. "Steels" (not shown) form each side of a mold (not shown) used for formation of the housing frame 12 come in from each side to form the parting line with the parting line being formed at the same time as those portions of the supporting wall which protrude above the nominal height of wall-like portions of said wall 35. The platform 24 is supported by a series of platform supports 122 disposed along each side of floor surface 124 of the wall 22. The platform supports 122 conveniently number four on each side of the floor 124 with a total of eight of the platform supports 122 being suitable. The supports 122 are disposed in interdigitated relationship with each other from side-to-side on said floor 124. Each platform support is comprised of an elongated body portion 126 which extends vertically from the floor 124 with a support shoulder 128 being formed inwardly of each of the platform supports 122, the platform 24 actually resting upon the support shoulders 128. The elongated body portions 126 terminate in an arcuate upper portion 130 upon which an interior portion of the cover 110 can be contacted for support of the cover 110 as will be described hereinafter. On an outward side of the platform support 122, a downwardly directed shoulder 132 is formed for receiving in a snap-fit fashion a portion of the cover 110 as will be described hereinafter. In essence, the platform supports 122 act to support the platform 24 and to mount the cover 110 when a cover 110 is employed. Similarly, diffuser structure shown in FIGS. 4, 5 and 26 is mounted above the platform 24 as will be described hereinafter.

Figure 6:
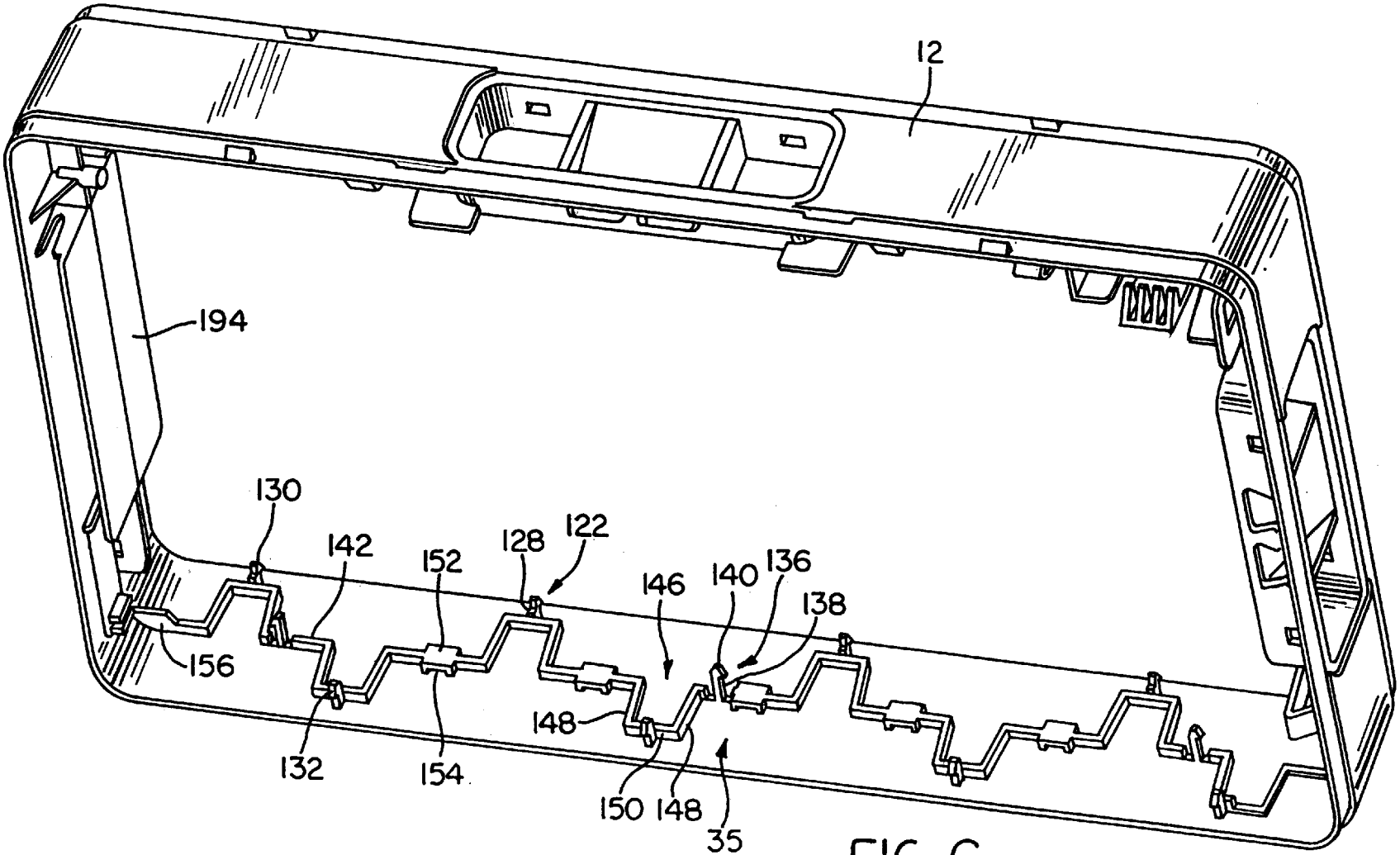
FIG. 6 is a perspective view of another embodiment of a housing frame differing in the snap-mounting structure used for mounting of a circuit board.

In the several embodiments, the platform 24 is provided with three spaced apertures 134 formed in the platform 24 through which upper portions of vertically oriented snap-fit elements extend for appropriately locating the platform 24 on the supporting wall 35 and for holding said platform 24 in place. In the embodiment of FIG. 6, snap-fit elements 136 extend from the floor 124 and have a downwardly facing shoulder 138 which contacts a portion of the platform 24 defining one edge of the aperture 134. A total of three of the snap-fit elements 136 are provided with two of the elements 136 having the respective shoulders 138 located on one given side of said elements 136 with the other snap-fit element 136 having the shoulder 138 formed on the opposite side thereof to provide a positive latching of the platform 24 to the supporting wall 35. Upper portions 140 of the snap-fit elements 136 are arcuately formed to facilitate snap-fitting of the platform 24 to the elements 136. The snap-fit elements 136 are seen to be disposed substantially along a centerline of the floor 124 which coincides with a line along which central portions of the supporting wall 35 lie. The supporting wall 35 is discontinuous at the locations of the snap-fit elements 136 in order to allow said elements 136 to be capable of resilient deformation when the platform 124 is snap-fit into place on the supporting wall 35.

In the embodiment of FIG. 6 the supporting wall 35 is further comprised of spaced central wall portions 142 which lie along the aforesaid centerline and which are discontinuous at the locations of the snap-fit elements 136 and which are also discontinuous at locations opposite each of the platform supports 122. At the locations of the platform supports 122, the supporting wall 35 extends toward each of the platform supports 122 and forms U-shaped wall portions 146 having side walls 148 and a bight wall 150, each platform support 122 being joined with each of the bight walls 150 at locations medially of the length of each of said bight walls 150. The "open" side of each of the U-shaped wall portions 146 are of a greater dimension than the length of the bight wall 150, thereby causing the side walls 148 to taper essentially inwardly to ends of the bight wall 150. Accordingly, the supporting wall 35 comprises a series of interdigitated U-shaped wall portions 146 along the length thereof. Rectangular pads 152 which can be square in a plan view are provided at spaced locations along certain sections of the spaced central wall portions 142. The pads 152 add strength to the supporting wall 35 and can be formed with open channels 154 extending therethrough from one lateral side of the pad 152 to the other lateral side thereof. The height of the spaced central wall protions 142, the U-shaped wall portions 146 and the pads 152 is nominally identical, the height of the structural elements being sufficiently low that upper portions thereof do not contact the underside of the platform 24. One end of the supporting wall 35 terminates in a supporting web 156 which extends into contact with an interior side face of the housing frame 12 while the other end of the supporting wall 35 reduces in height to form a connecting wall 157 which connects with a supporting web 158 formed on the opposite interior side wall of the housing frame 12.

The supporting wall 35 of FIG. 6 can be seen in essence to be "wavy" by virtue of the interdigitated U-shaped wall portions 146, the supporting wall 35 being "wavy" even though formed of essentially straight-line segments. A sinusoidal "wavy" supporting wall could be provided which would add strength to the floor 124 of the housing frame 12 much in the manner of the supporting wall 35. However, the supporting wall 35 as shown is more easily fabricated in the molding process by which the housing frame 12 is formed. A wall arranged in a straight line is less useful since it is desirable to form a non-linear parting line, that is, a "wavy" parting line, for ease of fabrication. Further, the formation of discontinuities in a straight wall substantially reduces the strength of such a wall. A variety of other shapes can be provided and will have utility in the manner of the supporting wall 35, such alternative geometries being most generally referred to as non-linear. Since the height of wall sections is limited, shape retention and thus dimensional stability is readily retained.

Referring now to FIGS. 1, 3, 7, 8 and 9A–9C, a preferred embodiment of the supporting wall 35 is seen to differ substantially only in the differing snap elements used in this embodiment in place of the snap-fit elements 136 of FIG. 6. Snap-fit elements 300 are employed in the preferred embodiment at two locations of the prior elements 136, that is, the central location and one of the end locations. A retaining element 302 is employed at the other end location, the elements 300 and 302 being received within slots formed in the platform 204 as have been previously described as the apertures 134. As can best be seen in FIGS. 7, 8 and 9A through 9C, the elements 300, 302 do not require discontinuities in the wall 35 in order to provide necessary function. The snap-fit elements 300 do not extend all the way to the floor 124 on which the wall 35 is formed merely to prevent "sink" marks on the corresponding external wall of the frame 12 which would occur during manufacturing. The retaining element 302 is of a thickness essentially identical to the thickness of primary portions of the wall 35.

The centrally disposed snap-fit element 300 partially mounts to one of the pads 152 while the other snap-fit element 300 mounts directly to a longitudinally straight portion of the wall 35. Each of the snap-fit elements 300 are identical in structure. However, it is preferred that the centrally disposed snap-fit element 300 is positioned so that a flexing distal portion 304 is oriented toward the retaining element 302. In the snap-fit element 300 disposed at the end of the exit sign 10 opposite that end bearing the retaining element 302, the flexing distal portion 304 is oriented toward the opposed side wall of the frame 12. A description of one of the snap-fit elements 300 will suffice for a description of both. The flexing distal portion 304 is joined to a body portion 306 by neck portion 308, the neck portion 308 being essentially arcuate and of a constant radius in order to evenly distribute stress. The body portion 306 of the element 300 does not flex but remains stationary during snap-fitting of the platform 24 in place, only the flexing distal portion 304 deforming or deflecting on receipt of the element 300 into one of the apertures 114. A vertical body wall 310 defining the body portion 306 on the opposite side thereof from the distal portion 304 contacts a wall portion of the aperture 134 and provides holding power. That point about which the distal portion 304 deflects or pivots is located in the neck portion 308, the body portion 306 therefore remaining stationary and not deflecting during the snap-fitting operation. By contrast, the snap-fit elements 136 of FIG. 6 pivot essentially at or near the lowest point of the elements 136 and thereby have a tendency to permanently deform during the snap-fitting operation. The snap-fit elements 300 further allow a snap-fit close to a wall or other structure such as the floor 124 of the frame 12. When coupled with ease of manufacture, it is to be seen that the structure of the snap-fit elements 300 is preferred.

An angled body wall 312 defines the other side of the body portion 306 and provides an enlarged part of the body portion 306 at lowermost portions thereof where said body portion 306 is provided with a base extenstion 314 which provides further stability to the element 300. The free end of the distal portion 304 is provided with a flat 316 which cuts away the outer corner thereof to prevent an edge portion of the platform 24 defining one of the apertures 114 from digging into outwardly disposed surfaces of the distal portion 304. The snap-fit elements 300 are integrally formed with remaining portions of the frame 12 from a polymeric material as aforesaid. Use of less deformable plastics such as polycarbonates in a polymeric formulation invites formation of the snap-fit elements 300 in the configuration shown since only the distal portion 304 deflects with the stress involved in that deflection being managed around the full curvature of the neck portion 308 and being evenly distributed thereal-ong. The particular relative dimensions of the snap-fit element 300 as shown in FIG. 9C inter alia particularly provide structure having substantial use advantages.

The retaining element 302 has a vertical body portion 318 which rounds distally to an arcuate extended portion 320 which terminates in a horizontal shoulder 322. The height of the retaining element 302 is approximately one-half the height of the snap-fit elements 300, the retaining element 302 primarily functioning as a connection locus whereby the corresponding aperture 134 in the platform 24 receives the retaining element 302 such that the two snap-fit elements 300 can then be snap-fit into the remaining apertures 134 in the platform 24. The extended portion 320 facilitates the retention of a retaining element 302 in the aperture 134 with portions of the platform 24 defining said aperture 134 essentially biasing against and contacting the horizontal shoulder 322 at least during mounting of the platform 24. The shape of the retaining element 302 coupled with the unflexed dimensions of the snap-fit elements 300 act to positively hold the platform 24 within the frame 12, this mounting of the platform 24 in relation to the wall 35 and in relation to the elements 300, 302 actually providing strength and rigidity to the overall structure of the exit sign 10. This contribution to strength and rigidity is particularly desirable in the exit sign 10 wherein walls of the frame 10 inter alia are formed to be exceptionally thin. In prior art plastic signage, body walls have been formed of greater amounts of plastic material to provide a desired strength and rigidity to the given sign, particularly in signage having emergency capability wherein a battery is carried within a sign. The strength and rigidity thus imparted by the wall 35 and the platform 24 mounted thereto becomes important in an overall consideration of the strength and rigidity of the sign itself. It is finally to be noted relative to the snap-fit elements 300 that free end portions of the distal portion 300 do not apply pressure to the platform 24, there typically being a 30/1000 spacing therebetween the "unmoving" side wall of each of the elements 300, that is, the vertical body walls 310 which prevent movement of the platform 24 from side to side and thereby provide the positive retention necessary for most effective functioning of the structure.

While the cover 110 of FIGS. 14 and 15 has been alluded to briefly herein a preferred covering structure for the platform 24 is best seen in FIGS. 4 and 5 with mounting structure associated therewith being also seen in FIGS. 1 and 3. The covering structure of these figures is referred to herein as a diffuser 400 and is similar in structure and function to a diffuser structure described in copending U.S. patent application Ser. No. 08/850,493, entitled "Light Distribution Diffuser for Exit Signs and the Like Illuminated by LED Arrays" and assigned to the present assignee, this application being filed of even date and being incorporated hereinto by reference. The diffuser 400 is formed of a textured polymeric material capable of diffusing light incident thereon on interior portions thereof, such light being provided by the light emitting diodes 30 mounted on the platform 24 which the diffuser 400 substantially covers. The diffuser 400 provides a certain degree of protection for the platform and those elements mounted thereto and further provides some protection against shock through inadvertent touching of electrified elements mounted on the platform 24. Apertures 402 formed in apexal ridge 404 of the diffuser 400 are located above the light emitting diodes 30 carried on the platform 24. The apertures 402 are sized and located at a distance from the light emitting diodes 30 such that approximately fifty percent of an upper cone of light produced by said diode passes through the apertures, remaining light emanating from the diodes 30 diffusing through the diffuser 400 to illuminate lower portions of the indicia 16. Reference is made to the aforesaid patent application for additional disclosure relevant to the diffuser 400.

As is seen in FIGS. 1 and 3 in particular, mounting posts 406 are carried by the platform 24 and have distal nub portions 408 which are split to snap-fit into mounting apertures 410 formed in the apexal ridge 404 of the diffuser 400. Openings (not shown) can be provided in body walls of the diffuser 400 to accommodate structure extending upwardly from the platform 24. Further, discontinuities in the body of the diffuser 400 can be provided, such as elongated notch 412 which allows a bending of an end portion of the diffuser 400 to access the battery 32. The notch 412 enables that portion of the diffuser 400 surmounting the battery 32 to be folded back for access to the battery 32 and mounting structure associated with the battery 32.

Referring now to FIGS. 1 and 3 through 9 in particular, that structure remaining on the housing frame 12 and which is integrally formed therewith is now described in the absence of previous description. A supporting web 160 extendsbetween the supporting webs 156 and 158 located at respective ends of the floor 124. While the supporting web 160 is not continuous in a strict sense, that structure such as the structure defining the openings 112 as an example essentially act to continue the supporting web 160 and thereby to provide strength to the housing frame 12. Immediately above the supporting web 158 at one end of the housing frame 12, a wire management snap 162 extends from the web 160 and surmounts opening 164 which is also utilized in wire management. Anchor openings 166 are provided in walls 168 which act to partially define the openings 112, the anchor openings 166 being disposed at an inner edge of ramp 170 which is centrally located within each of the openings 112. The anchor openings 166 will be described in detail hereinafter relative to the structure thereof and to the function of routing wiring within the interior of the exit sign 10. Pegs 172 extend from the supporting web 160 in aligned relation from interior walls of each side of the housing frame 12, the pegs 172 being utilized as will be described hereinafter for mounting of the rear mounting plate 18 to the housing frame 12. Lateral webs 174 and 176 on respective sides of the pegs 172 act as pilaster elements to provide additional strengthening and support for the supporting web 160 in the vicinity of the pegs 172, this strengthening being desirable due to loading which will be carried by the pegs 172 when mounted to the rear mounting plate 18 as will be described hereinafter.

A hook element 175 extends laterally from the supporting web 160 and also functions in the management of wiring which is to be routed within the interior of the exit sign 10. Immediately to the left of the hook element 175 is a compartment 177 which mounts a capacitor (not shown) which is wired into the circuitry of the exit sign 10 when 277 volts AC is used for operation of the sign. The capacitor (not shown) contained within the compartment 177 is wired into system circuitry in a known fashion while reposing within the compartment 177. A snap element 178 facilitates mounting of the capacitor (not shown) within the compartment 177. A wire management snap 180 extends from the supporting web 160 to the interior side of the compartment 177 and surmounts opening 182 formed in said web 160. A DC lamp mounting plate 184 is offset from the web 160 in adjacent relation to the snap 180 and to the side of a location at which an AC lamp holder such as the lamp holder 34 of FIGS. 16 through 18 can be molded for embodiments of the present exit signs which utilize AC lamping. FIGS. 1 and 3 through 9 do not show an AC lamp holder in this location since such a holder is not required in the embodiment of the invention shown in these figures. While the DC lamp mounting plate 184 is also not utilized in the embodiment of FIGS. 1 and 3 through 9, the plate 184 remains in the housing frame 12 for convenience. A wire management tab 186 extends from a top inner surface of the housing frame 12 at the edge thereof and angles inwardly as does a similar wire management tab 186 formed on the opposite side of the opening 112 formed in a top wall of the housing frame 12. The walls 168 defining the opening 112 in the top side of the housing frame 12 further define the anchor opening 166 as will be described hereinafter in greater detail. Plates 188 having a horizontal disposition are formed at either end of the openings 112 in adjacent relation to the walls 168, the plates 188 providing a strengthening function as well as being useful in wire management. Outwardly of the DC lamp mounting plate 184 formed near the end of the housing frame 12 opposite the compartment 176 is an expanded portion 190 of the supporting web 160 having elongated apertures 192 formed therein, the expanded portion 190 being useful for the placement of labels (not shown) with the apertures 192 being useful in wire management if necessary. Immediately below the peg 172 located below the expanded portion 190 is a rectangular plate 194 which can provide a reflecting surface and/or be used for the placement of labels (not shown). Side walls 196 extending from the supporting web 160 and facilitating support of the plate 194 are provided with open-ended slots 198 for facilitation of the management of wiring. A series of slots (not shown) can be formed in the supporting web 160 and used for the placement of wire ties (not shown) to facilitate tying of structure to the housing frame, which structure is to be contained within the exit sign 10 as a matter of convenience. Descriptive matter concerning a storage compartment located internally of a sign housing as well as material further describing a housing frame of a sign housing is provided in U.S. Pat. No. 5,979,673, referred to hereinabove and incorporated hereinto by reference.

Figure 9A:
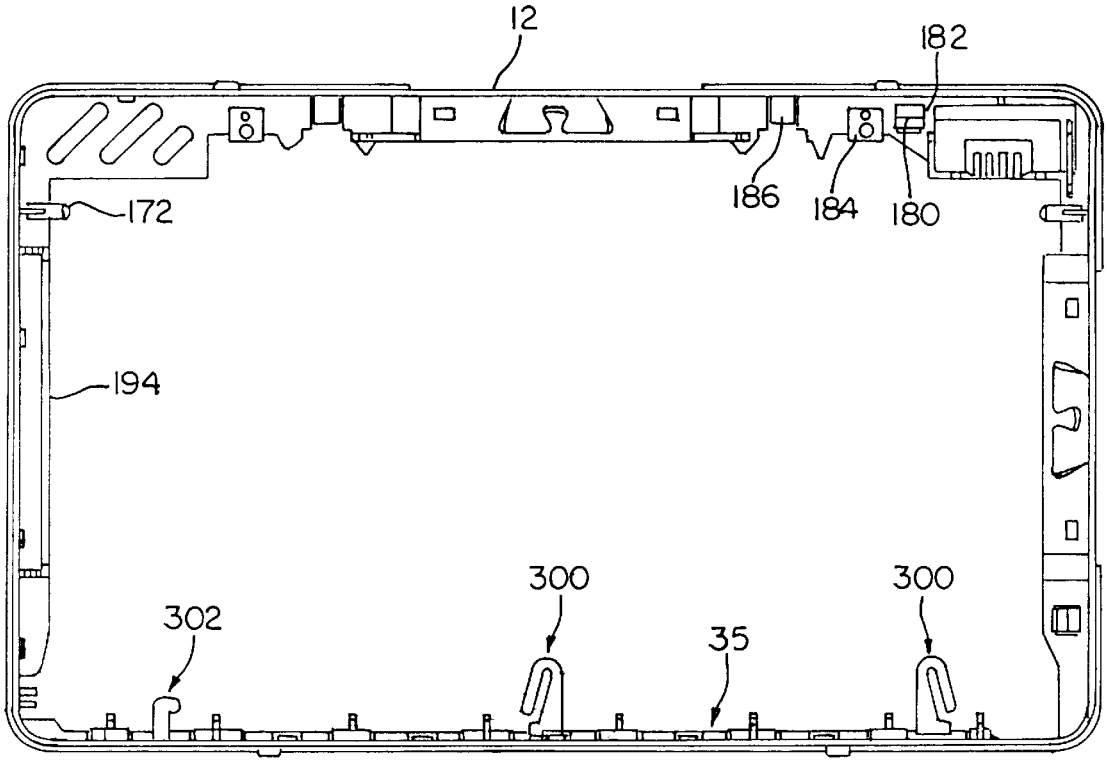
FIG. 9A is a front elevational view of the housing frame of FIG. 7.
Figure 9B:
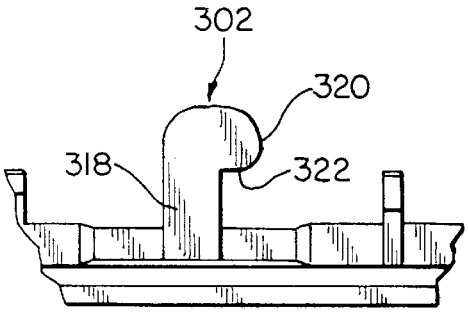
FIG. 9B is a detail front elevational view of a board holding post.
Figure 9C:
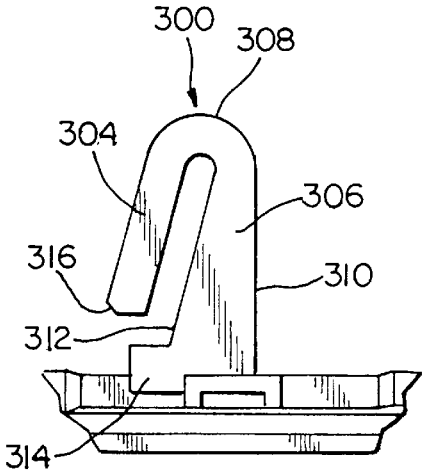
FIG. 9C is a detail front elevational view of a snap.
Figure 10:
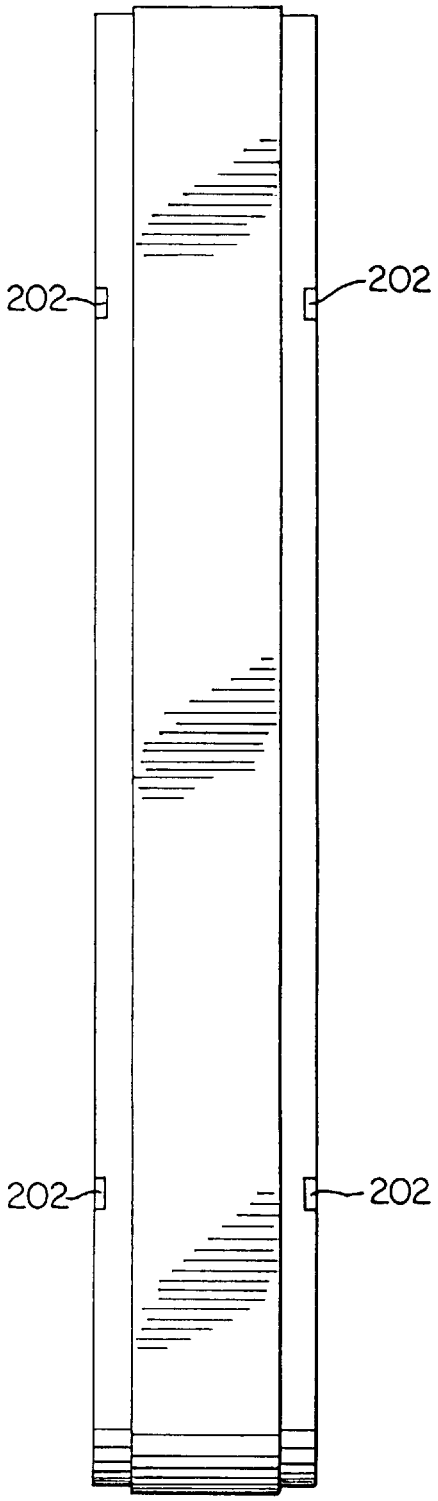
FIG. 10 is an elevational view of the housing frame of FIG. 7 taken from the bottom of the frame.
Figure 11:
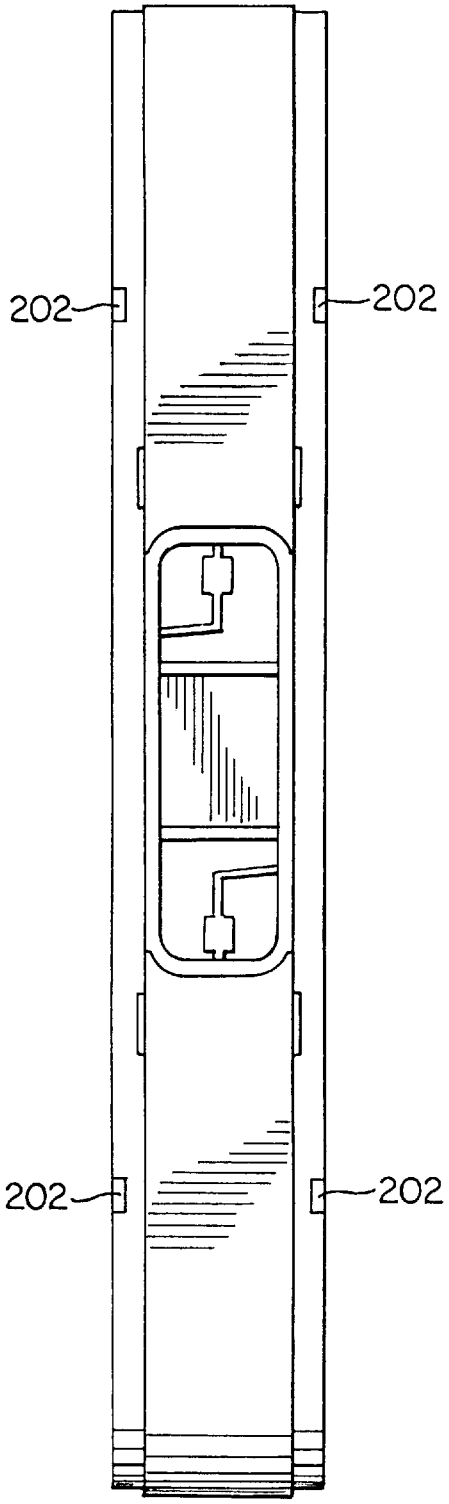
FIG. 11 is a plan view of the housing frame of FIG. 7.
Figure 12:
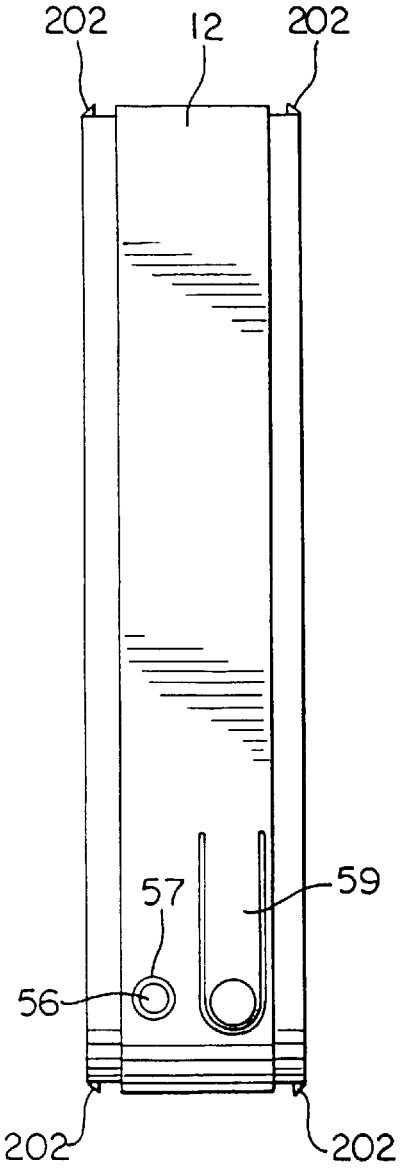
FIG. 12 is a side elevational view taken from the left of the housing frame of FIG. 7.
Figure 13:
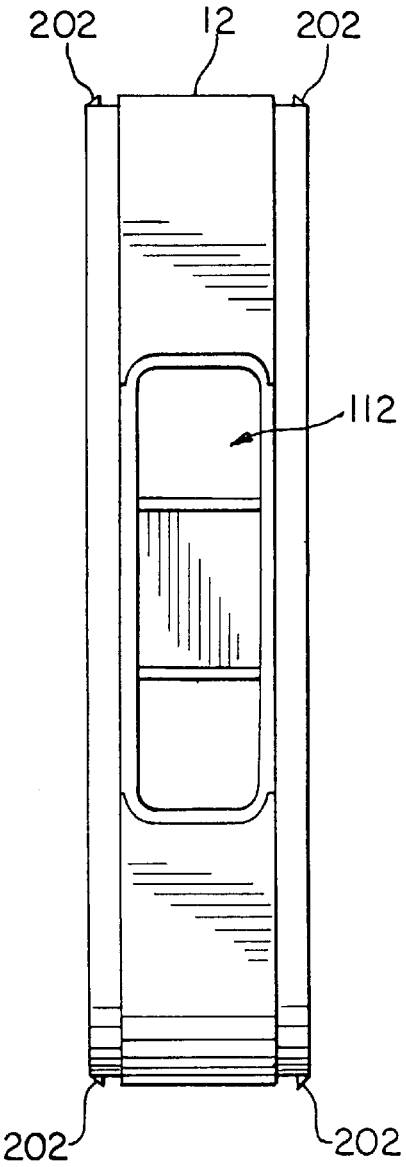
FIG. 13 is a side elevational view of the housing frame of FIG. 7 taken from the right thereof.

Referring now to FIGS. 9A and 10 through 13, the housing frame 12 of the invention can be seen in a front elevational view in FIG. 9A and in four elevational views in FIGS. 10 through 13. FIGS. 9A and 10 through 13 particularly show mounting tabs 202 formed two each on each side of top and bottom protions of the housing frame 12. As is also seen in FIG. 1, the tabs 202 can be seen to fit into slots 204 correspondingly formed in peripheral portions of the front cover plate 14 and the rear mounting plate 18, the mounting tabs 202 snap-fitting into the slots 204 to hold the plates 14 and 18 to the housing frame 12 in a manner known in the art.

Referring now to FIGS. 14 and 15, the cover 110 referred to above is seen to comprise an elongated body member 206 having a dome-like cross-section as is best seen in FIG. 15. The elongated body member 206 is provided with a skirt 208 on each lower side thereof, each of the skirts 208 terminating in rounded edges 210 which turn inwardly along the lengths thereof to form snap shoulders 212. Immediately above and spaced from the snap shoulders 212 are elongated support webs 214 which extend the length of the cover 110 on each side thereof interiorly of the confines of the cover 110. The cover 110 is thus snap-fit onto the several platfrom supports 122 of this embodiment of the invention with the snap shoulders 212 of the cover 110 fitting against the support shoulders 128 of the platform support 122. The support webs 214 bias against the arcuate upper portions 130 of the platform supports 122 to positively hold the cover 110 in place. The cover 110 can be simply formed of a material which is sufficiently translucent so that light from the light emitting diodes 30 diffuses specularly through the cover 110. Light from the light emitting diodes 30 is therefore substantially diffused into the interior of the exit sign 10 and the light from the light emitting diodes 30 is diffused within the interior of the exit sign 10 rather than having the characteristics of light emanating from a number of spaced point sources such as would otherwise characterize the light emitted by the light emitting diodes 30 which are spaced along the length of the platform 24. The use of the cover 110 is optional and is more desirable when the light emitting diodes 30 are "blue" light emitting diodes as has been described hereinabove. As indicated previously, however, the diffuser 400 previously described is preferred to use of the cover 110.

Referring now to FIGS. 16 through 18, the housing frame 108 is seen to be formable from the same mold as forms the housing frame 12 previously described. Due to the substantial similarities between the housing frame 108 and the housing frame 12, it is not necessary to note such similarities as they will be readily apparent to those of ordinary skill in the art. As aforesaid, the housing frame 108 is provided with vent openings 106 which are necessary due to the use of AC lamping 111 mountable in the AC lamp holders 34. As previously noted, the AC lamp holders 34 are preferably not formed during the molding process when production of the housing frame 12 is desired. Ventilation is enhanced by the provision of elongated slots 216 which are formed in the top portion of the housing frame 108. The slots 216 are formed in a rectangular pattern of four of said slots with the slots being at the corners of the rectangular pattern. The housing frame 12 also includes the slots 216. However, the slots 216 in the housing frame 12 function as a manufacturing expedient as do the slots 216 in the housing frame 108. The slots 216 simply provide an additional function in the housing frame 108 as indicated.

The two DC lamp mounting plates 184 which were described previously as forming an offset portion of the supporting web 160 of the housing frame 12 function when necessary in the housing frame 108 to hold DC lamping 113 as best seen in FIGS. 17 and 18. A forward face of each of the plates 184 has a cylindrical boss 218 which rises vertically from said face. The boss 218 has a circular upper surface which slants downwardly toward the free end of the plate 184 substantially to the planar face of said plate 184. The structure bearing the DC lamping 112 is provides with a metal base 219 and extension 221 which mounts lamp holder 223. An aperture 225 formed in the base 219 and being circularly shaped fits over the boss 218. The metal base 219 is thus snap-fitted onto the plate 184, the aperture 225 sliding over the angled upper portion of the boss 218 to fit onto said boss 218. The plates 184 can be used to mount other structure within the interior of the exit sign described herein. Both of the plates 184 can be used to mount supporting arms (not shown) of a platform (not shown) or the like for suspension of structure within the interior of the present signs. Such structure could include a reflective wall (not shown) mountable just above the indicia 16 for reflection of light through said indicia 16.

The housing frame 108 mounts a front cover plate and a rear mounting plate of essentially identical construction to the front cover plate 14 and the rear mounting plate 18 of FIG. 1. In exit signs formed with either of the housing frames 12 or 108 as primary structural elements, disclosure relative to the plates 14 and 18 apply equally. As an example, the front cover plate 14 is typically formed with the indicia 20 making out the word "EXIT". However, it is to be understood that other indicia could be formed in the face of the plate 14 such as is conventional in the art. The sign panel 20 in the several modifications thus described herein preferably forms a diffusion panel when used with incandescent lamping as is intended when the housing frame 108 is employed. Whether or not provided with a transformation material for embodiments of the invention utilizing the housing frame 12 and light emitting diodes as light sources, it is preferable in all forms of the invention to utilize a mounting arrangement for the sign panel 20 which allows assembly in only one orientation of the panel 20 to facilitate manufacture of the front cover plate 14 inter alia. In those embodiments of the invention wherein a transformation material is provided on one surface of the sign panel 20, it is necessary that the sign panel 20 be mountable to the front cover plate 14 in only one orientation in order that the transformation coating is located on the inside face of the sign panel 20. A sign panel mounting arrangement of particular utility is disclosed in U.S. Pat. No. 5,797,673 referred to hereinabove and incorporated hereinto by reference. In a preferred fabrication of the exit sign 10 and other exit signs envisioned according to the invention,the sign panel 20 can be a simple rectangular sheet fixed to the front cover plate 14 or similar cover plate in a conventional manner.

Exit signs formed according to the invention and utilizing the rear mounting plate 18 are mounted in a direct wall mount directly against a J-box (not shown) disposed flushly in a vertical wall (not shown) in a manner substantially similar to the mounting arrangement described in U.S. Pat. No. 5,797,673, referred to hereinabove and incorporated hereinto by reference. In the present exit signs, however, snap elements 220 and 222 are each located respectively near respective lateral side portions of the plate 18 and spaced from centrally disposed knock-out pattern 224. After mounting of the plate 18 to the J-box (not shown) through use of appropriate knock-outs in the knock-out pattern 224, the frame 12 is fitted onto the plate 18 with the snap elements 220 and 222 respectively engaging one of the pegs 172 extending inwardly in aligned relationship from interior side walls of the frame 12. Apertures 226 formed one each in each of the snap elements 220 and 222 receive the respective pegs 172. The housing frame 12 is thus snap-fitted to the rear mounting plate 18. Angled tabs 228 provide a portion of the snap elements 220, 222 which are available for grasping by a user in order to bias the substantially resilient snap elements 220, 222 inwardly to allow engagement with the pegs 172 or to disconnect the pegs 172 from the snap elements 220, 222 when disassembly is desired.

Referring now to FIGS. 19 through 24, a feature of the invention is shown which is important to management of wiring which is to be routed within the interior of the exit sign 10. The concept of "wire management" is known in the art and is important for a number of reasons including in the present invention the desirability of maintaining wiring in close relation to interior walls of the housing frame 12. Lighting efficiency is reduced when wiring haphazardly extends into the interior of the central interior space of the sign 10. The anchor opening 166 shown in detail in FIGS. 19 through 24 is formed as aforesaid in one of the walls 168 defining one of the openings 112. The anchor opening 166 could be formed in other structure and provide the function intended. In the situation shown in FIG. 3 inter alia, the anchor opening 166 further prevents wiring from extending into the opening 112 which would interfere with mounting of a canopy (not shown) and associated connecting structure to the exit sign 10. As seen in FIG. 3, two anchor openings 166 are formed at the "bottom" of the ramps 170 which are located centrally within the openings 112. Each of the anchor openings 166 are defined in part by spaced parallel planar surfaces 230 and 232, the surfaces 230 and 232 being flat and disposed in opposing relation to each other. As seen in FIG. 3 and in FIGS. 19 through 23 in particular, a tongue 234 having a substantially triangular shape extends centrally from the surface 232 toward the surface 230. Neck portion 236 of the tongue 234 joins to the surface 232 with radiused corners 238 providing an arcuate transition of the neck portion 236 at the connection thereof to the surface 232. Upper and lower surfaces of the tongue 234 are substantially planar and parallel to each other. The distal end of the tongue 234 is formed in an arcuate bevel 240 which curves from side to side and from top to bottom, corners 242 of the bevel 240 also being rounded. The radius of the distal end of the tongue 234 is seen to be accelerating.

Each of the anchor openings 166 is shaped substantially in the manner of a parallelogram except that corners 244 are rounded and slope downwardly from an upper portion of each side wall 246 to form an angled surface 248 which tapers toward the surface 230. Immediately below the angled surface 248 is disposed a complementary surface 250 which has its greatest width near the surface 230 and a lesser width in the corner 244. The side walls 246 are thus both formed of complex surfaces which have the effect of preventing binding or pinching of wiring passing over and lying against said side walls 246. Accordingly, a wire (not shown in FIGS. 19 through 33) can be looped into the anchor opening 166 between the bevel 240 of the tongue 234 and the opposing surface 230 and then drawn toward the neck portion 236 of the tongue 234 and toward the corners 244. This structure, in combination with the radiused corners 238, receive and hold such a wire without binding and pinching as aforesaid but with substantial and unexpected retaining capability. The anchor opening 166 can be utilized in wiring environments other than as shown relative to the exit sign 10.

Figure 23:
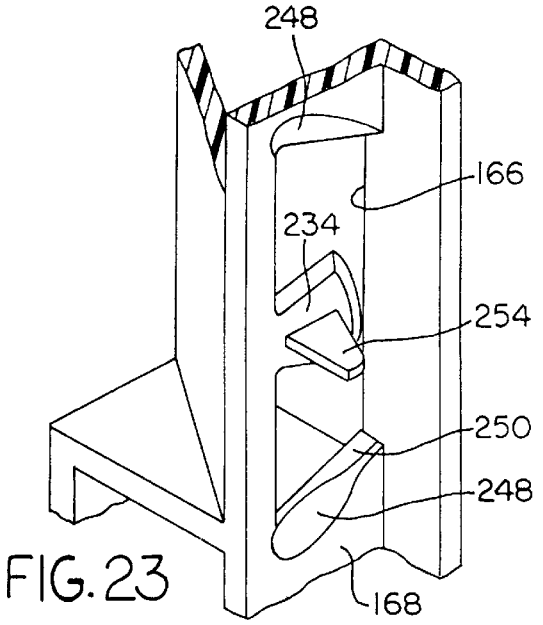
FIG. 23 is a perspective view of a further embodiment of a wire management device.
Figure 24:
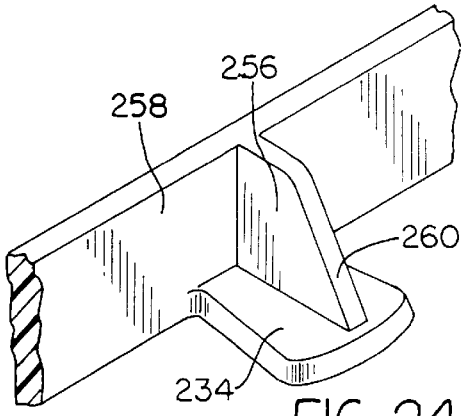
FIG. 24 is a further perspective view of yet another wire management device.

As seen in FIG. 23, a ramp 254 acts as a guide to facilitate the placement of wires (not shown) into the anchor opening 166 and over the tongue 234. The ramp 254 is disposed centrally of the tongue 234 and is preferably formed integrally with the tongue 234. The ramp 254 simply provides structure which eases wire placement so that wires can be placed in the anchor opening 166 whereby said wires are maintained substantially straight in an inward/outward manner biased by the surrounding structure to allow management of wiring essentially on a planar surface. FIG. 24 further illustrates a ramp 256 which fits between a tongue 234 and a wall 258 extending perpendicularly to the tongue 234. One edge of the ramp 256 is formed along the tongue 234 while a second edge of the ramp 256 is formed along the wall 258, thereby leaving free edge 260 of the ramp 256 to act as a guide.

Figure 25:
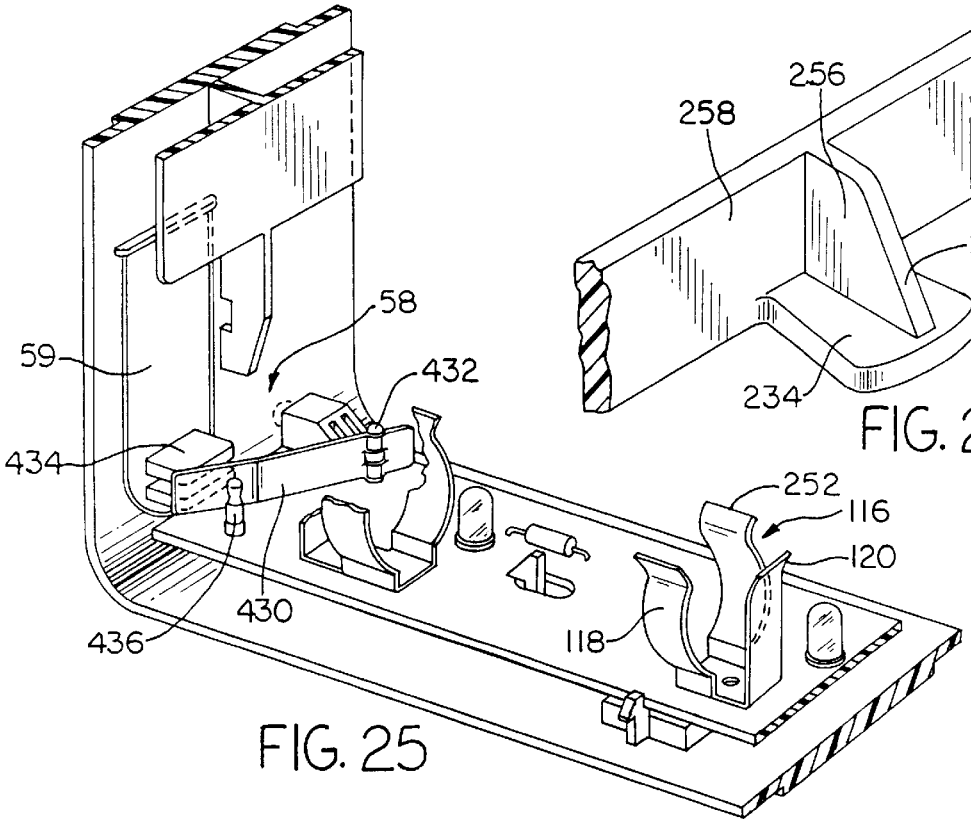
FIG. 25 is a perspective view of a mechanism used for snap-fitting of a battery to a printed circuit board platform according to the invention.
Figure 27:
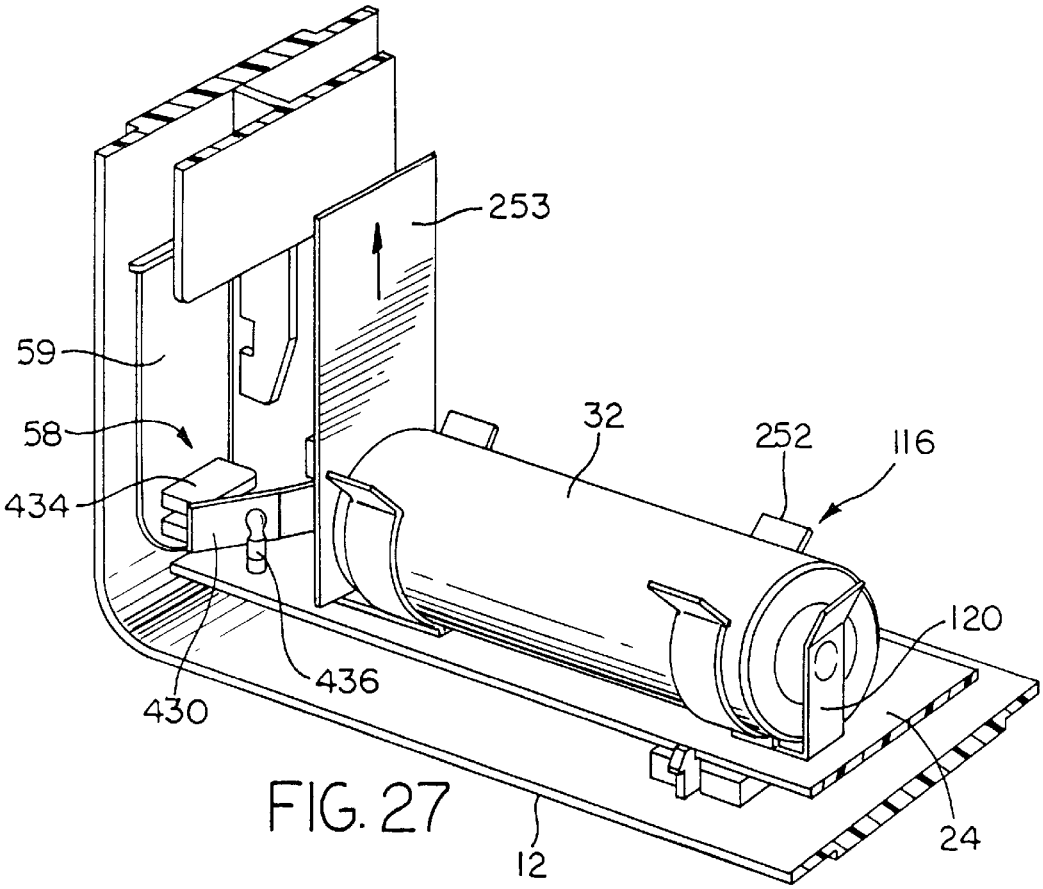
FIG. 27 is a perspective view of a mechanism used for preventing a battery from electrical connection to the circuit of the invention prior to installation.
Figure 28:
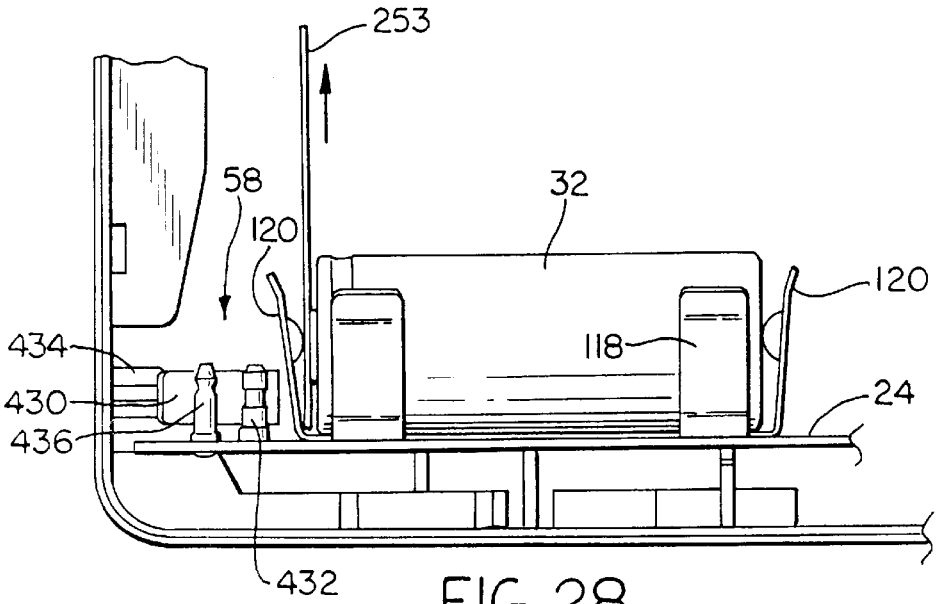
FIG. 28 is a side elevational view of the structure of FIG. 27.

Referring now to FIGS. 25, 27 and 28, the battery clip mounting arrangement 116 is seen in greater detail to be mounted directly to the platfrom 24 and to comprise the clips 118 into which the battery 32 is snap-fit for rapid mounting of the battery to the mounting arrangement 116. The distal ends of the clips 118 are provided with angled tab portions 252 which facilitate placement of the battery into the mounting arrangement 116 and removal therefrom. The electrical connection clips 120 act not only to hold the battery 32 in place but also to provide electrical connection between the battery and remaining portions of the circuit 26 when tab 253 is removed on installation of the exit sign 10 in a use situation. The tab 253 prevents electrical connection of the battery 32 to system circuitry until the exit sign 10 is operational. In this manner, it is therefore not necessary to wire the battery into system circuitry during installation of an exit sign which uses a battery for emergency power. Only one of the electrical connection clips 120 need be isolated from the battery 32 to accomplish this function.

FIGS. 25, 27 and 28 further best illustrate the test switch 58, said switch 58 comprising an electrically conductive flapper plate 430 pivotally mounted to post 432. Blocks 434 formed on interior surfaces of the actuator 59 bias against distal end portions of the plate 430 when the actuator 59 is manually depressed so that said plate 430 is pushed against conductive post 436, thereby completing circuitry as is conventional to energize the indicator light emitting diode 56 and thus confirm the charge of the battery 32. The test switch 58 would be provided in emergency versions of the invention including an incandescent emergency version utilizing a battery.

Figure 32:
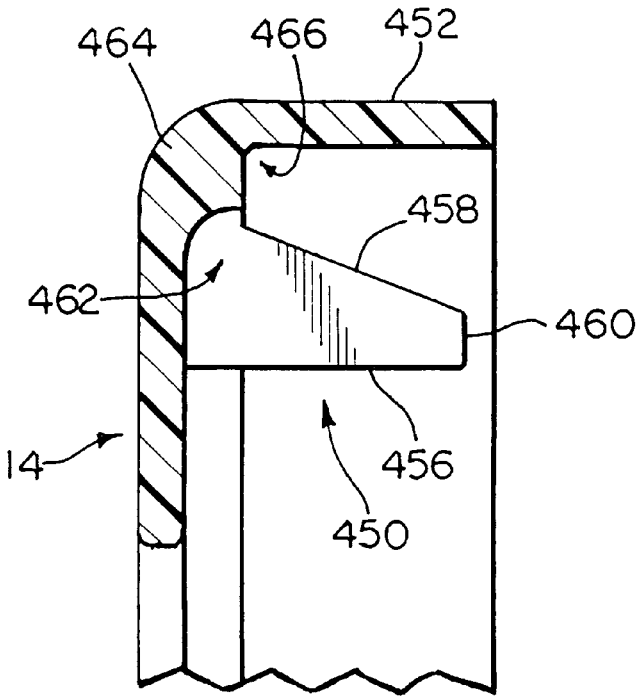
FIG. 32 is an enlarged detail view of the upper stops shown in FIG. 31; and, FIG. 33 is an enlarged detail view of the lower stops shown in FIG. 31.

Referring now particularly to FIGS. 29 through 33 and also to FIG. 1, structure carried by the front cover plate 14 and the rear mounting plate 18 which acts to impart additional rigidity to the exit sign 10 is shown. This structure can be seen on the rear cover plate 18 in FIG. 1 and in the rear view of the front cover plate 14 in FIG. 29 inter alia. Since the structure is substantially identical on both of the plates 14 and 18, a description of the structure relative to plate 14 is now provided. Upper stops 450 are seen in FIGS. 29, 31 and 32 to be formed on upper inner walls of the plate 14 essentially along a periphery of the top edge thereof and immediately below inwardly directed flange 452. The flange 452 extends about the entire periphery of the front cover plate 14 and receives a flange 454 extending about the full periphery of the frame 12 in a manner which is conventional in the art. Each of the upper stops 450 are spaced immediately inwardly of each of the slots 204. The upper stops 450 are substantially triangular in shape having a lower horizontal edge 456 and a sloped upper edge 458, the slope of the edge 458 being downwardly from the plate 14, the edges 456, 458 terminating in a blunt nose 460. A vertical edge 462 extends for a distance below an enlarged portion 464 of the plate 14 a distance which is less than the thickness of the flange 454, a small portion of the flange 454 along a lower edge thereof abutting against a portion of the vertical edge 462 when the plate 14 is assembled to the frame 12. Major portions of the edge of the flange 454 abut and contact a vertical edge 466 of the enlarged portion 464 of the plate 14.

Any force acting inwardly along the top wall of the frame 12 will be resisted by the upper stops 450 with increasing force being increasingly resisted by virtue of the geometry of the sloped upper edge 458 of said stops 450. Accordingly, the frame 12 is prevented from undesirable inward flexing on either inadvertent application of a force to the top of the frame 12 or an untrained application of force to the top of the frame 12 during an attempt to remove either one of the plates 14, 18 from the frame 12. Location of the upper stops 450 provides a "sweet spot" centrally of the top end of the frame 12 which, on pressing, allows ready removal of the plates 14, 18 from the frame 12. A desired rigidity is thus provided by the upper stops 450.

Figure 33:
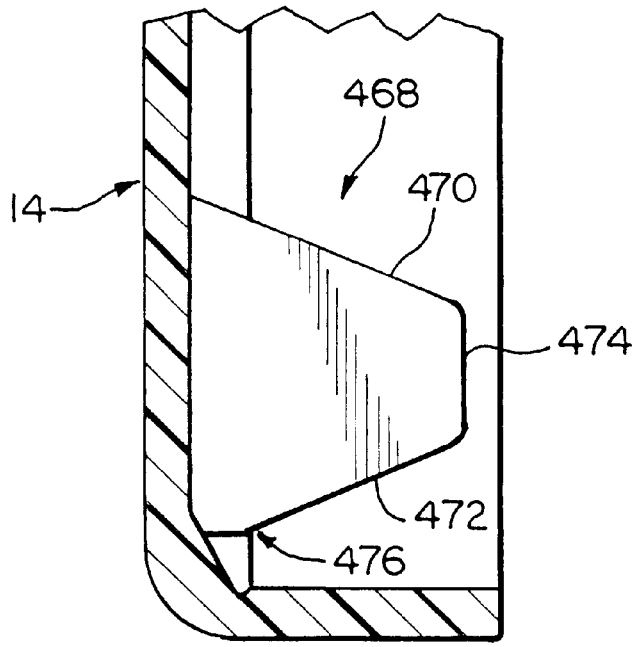

Further rigidity is imparted to the exit sign 10 by provision of lower stops 468 as particularly seen in FIGS. 29, 31 and 33. The lower stops 468 can be seen on the rear mounting plate 18 of FIG. 1 but are best seen on the front cover plate 14 of FIGS. 29 and 31. In a manner similar to the location of the upper stops 450, the lower stops 468 are provided one each inwardly of the slots 204 formed in a lower portion of the flange 452 which extends about the periphery of the plate 14. The lower stops 468 are preferably located more inwardly of the slots 204 than are the upper stops 450. Since the lower stops 468 formed on the plates 14, 18 are essentially identical in structure, a description of the stops 468 formed on the front cover plate 14 will suffice for a description of both. Essentially, the lower stops 14 are trapezoidal in conformation with upper and lower edges 470 and 472 angling downwardly and upwardly respectively to terminate in a blunt vertical edge or nose 474. While the upper edge 470 could be essentially horizontal, the edge is sloped in order to provide a larger base integrally attaching to inner wall portions of the plate 14 adjacent the periphery of the plate 14 along the lower edge thereof. A vertical edge 476 functions essentially in the same manner as the vertical edges 462 of the upper stops 450. Essentially, a portion of the outer edge of the flange 454 of the frame 12 contacts a portion of the vertical edge 476. A force directed inwardly against the lower edge of the exit sign 10 is resisted by the lower stops 468 in a manner essentially identical to that described relative to the operation of the upper stops 450. The slope of the upper edges 458 of the upper stops 450 and the slope of the lower edges 472 of the lower stops 468 essentially cause the stops 450, 468 to be "ramped" stops which increasingly resist forces directed respectively against upper and lower edges of the exit sign 10. The upper stops 450 and the lower stops 468 are of particular importance in that these stops resist deformation of the platform 24 when force is applied against either the upper or lower edges of the exit sign 10.

Structure provided on the frame 12, on the cover plates 14, 18 and in the form of the platform 24 itself acts to impart necessary strength and rigidity to the exit sign 10 by acting essentially in combination, this strength and rigidity not otherwise being available given the reduced thickness of material used for formation of the frame 12 and the plates 14, 18. The combination of structure thus provided, some of the structure acting to accomplish other functions, act synergistically and even unexpectedly to provide this necessary strength and rigidity while allowing cost reduction due to the lesser amounts of polymeric material needed for formation of the frame 12 and the plates 14, 18.

Referring now to FIGS. 29 and 30, particular structure used for mounting of the sign panel 20 to the front cover plate 14 is shown. This structure is integrally formed with the plate 14. On inner walls of the plate 14 at either side end thereof, a holding tab 478 is provided to prevent side-to-side movement of the sign panel 20. Two upper snap elements 480 are provided inwardly of the top edge of the flange 452, the snap elements 480 each consisting of an upper plate 482 and a triangular nub 484. Lower snap elements 486 are provided in spaced relation to the lower edge of the flange 452 and extending from inner wall portions of the plate 14. The lower snap elements 486 are comprised of a plate 488 having a triangular nub 490 extending upwardly therefrom, the plate 488 being supported by spaced legs 492 one each of which extends from either lateral edge of the plate 488. The nubs 484 and 490 are each provided with an inwardly sloping edge 494 and 496 respectively to facilitate placement of the sign panel 20 in position for snap-fitting of said panel 20 between the upper snap elements 480 and the lower snap elements 486. Inward portions of the nubs 484 and 490 are formed as inwardly sloped edges 498 and 500 respectively which facilitate maintenance of the sign panel 12 in place between the snap elements 480, 486.

Particular embodiments of the invention have been described above in relation to illustrations of only a few preferred configurations of the invention as provided in the drawings. However, it should be understood that the invention can be embodied other than as shown herein and even further embodied other than is particularly described herein. The invention can be used in the construction of emergency lighting fixtures other than the particular illuminated signs described and shown. Accordingly, the scope of the invention is defined by the recitations of the appended claims.

What is claimed is:

1. A lighting fixture, comprising:

housing means for carrying at least certain components necessary to operate the fixture, the components comprising an illumination source, an emergency power source and a circuit including the illumination source and the power source, the housing means comprising a housing frame;

a platform carried by the housing means on which the illumination source, the emergency power source and at least certain discrete components of the circuit are mounted, the platform being elongated in conformation and being located essentially along the full extent of the lowermost edge of the housing frame interiorly of the housing means, the platform comprising a planar sheet of printed circuit board with the primary output of the illumination source being directed toward interior portions of that interior space defined by the housing means to provide maximum illumination within and throughout said space; and, means formed integrally with the housing frame along only the lowermost edge thereof for mounting the platform, for maintaining the platform in place and for imparting strength and rigidity to the housing means in combination with the platform mounted thereby, the fixture being capable of formation from materials of unusually thin gauge not otherwise having sufficient strength for practical support of a fixture carrying an illumination source and a power source within the interior thereof and being mountable from walls and ceilings for bearing the weight of said sources.

2. The fixture of claim 1 wherein the fixture comprises an illuminated sign of substantially rectangular conformation usable as an exit sign and the like and wherein the housing means comprises the housing frame and at least one cover plate attachable to the housing frame to enclose said interior space within the housing means, the platform being positioned within and carried by the housing frame at a location adjacent to and along a lowermost edge thereof, substantial central portions of the interior space being substantially vacant, light from the illumination source being reflected efficiently within the interior of the housing means and from interior walls of the housing frame.

3. The fixture of claim 2 and further comprising means for converting the housing frame to a plurality of lighting fixtures using differing illumination sources, power sources and circuitry.

4. The fixture of claim 2 wherein the platform is comprised of a printed circuit board and the illumination source, the power source and the discrete components of the circuit are formed as circuitry thereon.

5. The fixture of claim 2 and further comprising means carried by the housing means for mounting and supporting the platform.

6. The fixture of claim 5 wherein the mounting and supporting means comprise a series of interdigitated support elements extending along opposite sides of an interior wall of the housing means disposed along the lowermost edge of the housing frame, the support elements each having a shoulder upon which a portion of the platform rests, the support elements extending above and being joined along at least bases of the support elements to those portions of the interior wall extending below the platform and along the length thereof.

7. The fixture of claim 6 wherein the wall is non-linear over the length thereof.

8. The fixture of claim 6 wherein the wall is wavy over the length thereof.

9. The fixture of claim 6 and further comprising snap elements located in proximity to central portions of the wall to snap-fit to and hold the platform in place.

10. The fixture of claim 2 wherein the illumination source comprises an array of light emitting diodes.

11. The fixture of claim 2 wherein the power source comprises a battery.

12. The fixture of claim 1 wherein the housing frame is molded from a polymeric material.

13. The fixture of claim 1 wherein the illumination source comprises an array of light emitting diodes.

14. The fixture of claim 13 wherein the power source comprises a battery.

15. The fixture of claim 14 and further comprising an external power source disposed exteriorly of the housing means for operation of the light emitting diodes, the battery operating the light emitting diodes on discontinuation of power from the external power source, the circuit controlling application of power from the appropriate power source to the light emitting diodes.

16. The fixture of claim 15 and further comprising means forming a portion of the circuit for maintaining charge of the battery.

17. The fixture of claim 14 and further comprising means disposed on the platform for snap-mounting of the battery to the platform.

18. The fixture of claim 13 wherein the light emitting diodes are spaced apart along the platform in a substantially linear array.

19. The fixture of claim 1 and further comprising wire management means carried by the housing means for routing wiring within the interior of the housing means to maintain the wiring in locations away from said interior space.

20. The fixture of claim 19 wherein the wire management means comprise an anchor opening means formed in a wall portion of the housing means for carrying at least one wire, the anchor opening means having side walls formed with wall portions angled relative to each other, a tongue element extending into the interior of an opening defined in the wall portion of the housing means and having an arcuately beveled distal end portion, and radiused corners comprising at least certain corners of the opening.

21. The fixture of claim 20 and further comprising guide means joined to the tongue element for ramping wiring over the tongue element and into the opening means.

22. The fixture of claim 1 and further comprising mounting means joined to the housing means for supporting and attaching to a portion of a support element, the support element having an aperture formed therein, the mounting means comprising a surface having a boss element extending therefrom, the boss element having a slanted distal face, the mounting means further comprising means defining a recess into which portions of the support element extend and bias against structure defining the recess on fitting of the boss element into the aperture formed in the support element, the support element being snap-fit onto the mounting means by movement of the support element into engagement with the mounting means to cause at least portions of the support element defining the aperture to ride over the slanted distal face of the boss element whereupon continued movement of the support element causes the boss element to align with the aperture and to be received into the aperture.

23. The fixture of claim 1 and further comprising means carried by the housing means for releasably mounting the platform to the housing means, the platform having spaced apertures formed therein for receiving portions of the holding means therethrough, the holding means comprising snap-fit elements each having a body portion having one end joined to the housing means and a neck portion at the end thereof opposite the end which joins to the housing means, a first side wall of the body portion being essentially straight with a second side wall being angled relative to the first side wall, the neck portion being arcuate and having a constant radius, the neck portion terminating at the distal end thereof in a flexing distal portion which can be biased inwardly toward the second side wall of the body portion and which readily snaps back into an unbiased position due to location on the neck portion of that point about which the flexing distal portion deflects, the body portion remaining stationary during flexing of the flexing distal portion, the snap-fit elements being one each received into one of the apertures formed in the platform, the first side wall contacting an opposing wall of the aperture into which the snap-fit element is received to provide holding power, the flexing distal portion of the snap-fit element deflecting toward the second side wall of the body portion on contact with a portion of the platform defining the aperture to allow the snap-fit element to be received within the aperture, the flexing distal portion returning to an unbiased position once the snap-fit element is received into the aperture, thereby to hold the platform to the housing means.

24. The fixture of claim 23 and further comprising a retaining element received into one of the apertures.

25. The fixture of claim 24 wherein the retaining element is received within an aperture located substantially at one end of the platform and one of the snap-fit elements is received within an aperture located substantially at the opposite end of the platform, the flexing distal portion of the snap-fit element so located being oriented toward said opposite end of the platform.

26. The fixture of claim 25 wherein a second snap-fit element is received within an aperture located substantially medially of the platform, the flexing distal portion of the second snap-fit element being oriented toward the retaining element.

27. The fixture of claim 1 wherein the illumination source comprises an array of light emitting diodes.

28. The fixture of claim 1 wherein the power source comprises a battery.

29. The fixture of claim 1 wherein the means formed integrally with the housing comprise a series of interdigitated support elements extending along opposite sides of an interior wall of the housing means disposed along the lowermost edge of the housing frame, the support elements each having a shoulder upon which a portion of the platform rests, the support elements extending above and being joined along at least bases of the support elements to those portions of the interior wall extending below the platform and along the length thereof.

30. The fixture of claim 29 wherein the support elements form a supporting wall which is non-linear over the length thereof.

31. The fixture of claim 30 wherein the supporting wall is wavy over the length thereof.

32. The fixture of claim 30 and further comprising snap elements located in proximity to central portions of the supporting wall to snap-fit to and hold the platform in place.

33. The fixture of claim 1 and further comprising means cooperating with said integrally formed means and being functionally connected thereto for providing a strengthening web extending essentially about the inner periphery of the housing frame to provide rigidity to the housing frame and to the assembled fixture.

34. A lighting fixture comprising:

housing means for carrying at least certain components necessary to operate the fixture, the components comprising an array of light emitting diodes, a power source and a circuit including the array and the power source, the light emitting diodes being blue light emitting diodes and wherein the fixture further comprises a transformation material carried by the housing means, the transformation material being excited by the light emitted from the light emitting diodes to emit light from the fixture of a different wavelength band than the wavelength band emitted by the light emitting diodes; and, a platform carried by the housing means on which the array, the power source and discrete components of the circuit are mounted.

35. The fixture of claim 34 and further comprising a cover formed of a diffusion material disposed over the light emitting diodes.

36. A lighting fixture, comprising:

housing means for carrying at least certain components necessary to operate the fixture, the components comprising an illumination source, a power source and a circuit including the illumination source and the power source;

a platform carried by the housing means on which the illumination source, the power source and discrete components of the circuit are mounted; and, mounting means joined to the housing means for supporting and attaching to a portion of a support element, the support element having an aperture formed therein, the mounting means comprising a surface having a boss element extending therefrom, the boss element having a slanted distal face, the mounting means further comprising means defining a recess into which portions of the support element extend and bias against structure defining the recess on fitting of the boss element into the aperture formed in the support element, the support element being snap-fit onto the mounting means by movement of the support element into engagement with the mounting means to cause at least portions of the support element defining the aperture to ride over the slanted distal face of the boss element whereupon continued movement of the support element causes the boss element to align with the aperture and to be received into the aperture.

37. A lighting fixture, comprising:

housing means for carrying at least certain components necessary to operate the fixture, the components comprising an illumination source, a power source and a circuit including the illumination source and the power source;

a platform carried by the housing means on which the illumination source, the power source and discrete components of the circuit are mounted; and, means carried by the housing means for releasably mounting the platform to the housing means, the platform having spaced apertures formed therein for receiving portions of the holding means therethrough, the holding means comprising snap-fit elements each having a body portion having one end joined to the housing means and a neck portion at the end thereof opposite the end which joins to the housing means, a first side wall of the body portion being essentially straight with a second side wall being angled relative to the first side wall, the neck portion being arcuate and having a constant radius, the neck portion terminating at the distal end thereof in a flexing distal portion which can be biased inwardly toward the second side wall of the body portion and which readily snaps back into an unbiased position due to location on the neck portion of that point about which the flexing distal portion deflects, the body portion remaining stationary during flexing of the flexing distal portion, the snap-fit elements being one each received into one of the apertures formed in the platform, the first side wall contacting an opposing wall of the aperture into which the snap-fit element is received to provide holding power, the flexing distal portion of the snap-fit element deflecting toward the second side wall of the body portion on contact with a portion of the platform defining the aperture to allow the snap-fit element to be received within the aperture, the flexing distal portion returning to an unbiased position once the snap-fit element is received into the aperture, thereby to hold the platform to the housing means.

38. The fixture of claim 37 and further comprising a retaining element received into one of the apertures.

39. The fixture of claim 38 wherein the retaining element is received within an aperture located substantially at one end of the platform and one of the snap-fit elements is received within an aperture located substantially at the opposite end of the platform, the flexing distal portion of the snap-fit element so located being oriented toward said opposite end of the platform.

40. The fixture of claim 39 wherein a second snap-fit element is received within an aperture located substantially medially of the platform, the flexing distal portion of the second snap-fit element being oriented toward the retaining element.

41. A lighting fixture, comprising:

housing means for carrying at least certain components necessary to operate the fixture, the components comprising an illumination source, a power source and a circuit including the illumination source and the power source;

a platform carried by the housing means on which the illumination source, and at least portions of a circuit including the illumination source and the power source are mounted; and, wire management means carried by the housing means for routing wiring within the interior of the housing means, the wire management means comprising an anchor opening means formed in a wall portion of the housing means for carrying at least one wire, the anchor opening means having side walls formed with wall portions angled relative to each other, a tongue element extending into the interior of an opening defined in the wall portion of the housing means and having an arcuately beveled distal end portion, and radiused comers comprising at least certain corners of the opening.

42. The fixture of claim 41 and further comprising guide means joined to the tongue element for ramping wiring over the tongue element and into the opening means.

43. A lighting fixture, comprising:

housing means for carrying at least certain components necessary to operate the fixture, the components comprising an illumination source, a power source and a circuit including the illumination source nd the power source;

a platform carried by the housing means on which the illumination source and at least portions of the circuit including the illumination source and the power source are directly mounted thereon, and, means carried by the housing means for mounting the platform, for supporting the platform and for enhancing the rigidity of the housing means in concert with the platform.

44. The fixture of claim 43 wherein the mounting and supporting means comprise a series of interdigitated support elements extending along opposite sides of an interior wall of the housing means, the support elements each having a shoulder upon which a portion of the platform rests, the support elements extending above and being joined along at least bases thereof, a supporting wall extending below the platform and along the length thereof.

45. The fixture of claim 44 wherein the supporting wall is non-linear over the length thereof.

46. The fixture of claim 44 wherein the supporting wall is wavy over the length thereof.

47. The fixture of claim 44 and further comprising snap elements located in proximity to central portions of the supporting wall to snap-fit to and hold the platform in place.

* * * * *